US011170718B2

(12) United States Patent
Lin et al.

(10) Patent No.: US 11,170,718 B2
(45) Date of Patent: Nov. 9, 2021

(54) DISPLAY PANEL, DISPLAY DEVICE AND COMPENSATING METHOD

(71) Applicant: BOE TECHNOLOGY GROUP CO., LTD., Beijing (CN)

(72) Inventors: Yi Cheng Lin, Beijing (CN); Quanhu Li, Beijing (CN); Cuili Gai, Beijing (CN); Yu Wang, Beijing (CN); Mingi Chu, Beijing (CN); Chien Pang Huang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/839,580

(22) Filed: Apr. 3, 2020

(65) Prior Publication Data

US 2020/0234647 A1 Jul. 23, 2020

Related U.S. Application Data

(63) Continuation-in-part of application No. 15/781,937, filed as application No. PCT/CN2017/114398 on Dec. 4, 2017, now abandoned.

(30) Foreign Application Priority Data

May 12, 2017 (CN) ..... 201710335194.4

(51) Int. Cl.
*G09G 3/3258* (2016.01)
*G09G 3/3266* (2016.01)
*G09G 3/3275* (2016.01)

(52) U.S. Cl.
CPC ..... *G09G 3/3258* (2013.01); *G09G 3/3266* (2013.01); *G09G 3/3275* (2013.01)

(58) Field of Classification Search
CPC ..... G09G 3/32; G09G 3/3233; G09G 3/3258; G09G 3/3266; G09G 3/3275
See application file for complete search history.

(56) References Cited

U.S. PATENT DOCUMENTS 6,011,531 A * 1/2000 Mei ..... G09G 3/20 345/90
2013/0147690 A1 6/2013 Kim et al.
(Continued)

FOREIGN PATENT DOCUMENTS

CN 101191922 A 6/2008
CN 101770743 A 7/2010
(Continued)

OTHER PUBLICATIONS

Chinese Office Action dated Oct. 8, 2019.
(Continued)

*Primary Examiner* — Alexander Eisen
*Assistant Examiner* — Cory A Almeida
(74) *Attorney, Agent, or Firm* — Dilworth & Barrese, LLP.; Michael J. Musella, Esq.

(57) ABSTRACT

A display panel, a display device, and a compensating method are disclosed. The display panel includes: a plurality of sub-pixels arranged in rows and columns, a plurality of data lines connected to the plurality of sub-pixels, and a plurality of sensing driving lines connected to the plurality of sub-pixels, each of plurality of the sub-pixels includes a pixel circuit; the plurality of sub-pixels constitute a plurality of pixel units, the plurality of pixel units are arranged in a plurality of rows and a plurality of columns, and each of the plurality of pixel units includes four sub-pixels; pixel circuits of the four sub-pixels are connected to a same data line of the plurality of data lines; and the pixel circuits of the four sub-pixels are connected to four sensing driving lines of the
(Continued)

plurality of sensing driving lines in a one-to-one correspondence manner.

18 Claims, 12 Drawing Sheets

(56) References Cited

U.S. PATENT DOCUMENTS

| | | | | |
|---|---|---|---|---|
| 2015/0138179 | A1 | 5/2015 | Park | |
| 2015/0154913 | A1 | 6/2015 | Kim | |
| 2015/0325174 | A1* | 11/2015 | Yu | H01L 27/32 345/77 |
| 2016/0086537 | A1 | 3/2016 | Shin | |
| 2016/0267844 | A1 | 9/2016 | Senda et al. | |
| 2017/0039953 | A1 | 2/2017 | Lee | |
| 2017/0061865 | A1 | 3/2017 | Park | |
| 2018/0096654 | A1 | 4/2018 | Wang et al. | |
| 2019/0304369 | A1 | 10/2019 | Li et al. | |

FOREIGN PATENT DOCUMENTS

| | | | |
|---|---|---|---|
| CN | 103325814 | A | 9/2013 |
| CN | 104658474 | A | 5/2015 |
| CN | 104700773 | A | 6/2015 |
| CN | 105609051 | A | 5/2016 |
| CN | 106486059 | A | 3/2017 |
| JP | 2007286150 | A | 11/2007 |
| JP | 2011095720 | A | 5/2011 |
| JP | 2016126337 | A | 7/2016 |
| WO | 2015176108 | A1 | 11/2015 |

OTHER PUBLICATIONS

International Search Report dated Feb. 26, 2018.

Extended European search report issued by the European Patent Office for the corresponding European Patent Application No. 17899219.4. The EESR has an issue date of Oct. 29, 2020.

Japanese Office Action from Japanese Patent Application No. 2018550568 drafted Aug. 16, 2021.

* cited by examiner

DISPLAY PANEL, DISPLAY DEVICE AND COMPENSATING METHOD

This application is a Continuation-in-Part application of U.S. application Ser. No. 15/781,937 filed on Jun. 6, 2018, and the above-quoted U.S. application claims the priority of Chinese patent application No. 201710335194.4 filed on May 12, 2017.

TECHNICAL FIELD

Embodiments of the present disclosure relate to a display panel, a display device, and a compensating method.

BACKGROUND

In the field of display, organic light emitting diode (OLED) display panels have the characteristics of autoluminescence, high contrast, low power consumption, wide viewing angle, rapid response speed, capability of being applied in flexible panels, wide service temperature range, simple production, etc., and have a wide development prospect.

Due to the above characteristics, the organic light emitting diode (OLED) display panels can be applicable to devices with display function such as mobile phones, displays, notebook computers, digital cameras, and instruments and meters.

SUMMARY

At least one embodiment of the present disclosure provides a display panel, and the display panel comprises: a plurality of sub-pixels arranged in rows and columns, each of the sub-pixels comprising a pixel circuit; a plurality of sensing driving lines respectively connected with pixel circuits of the plurality of sub-pixels; and a sensing driver connected with the plurality of sensing driving lines. The pixel circuit comprises a light emitting element, the sensing driver is configured to sense electrical parameters of light emitting elements of the pixel circuits of the plurality of sub-pixels through the plurality of sensing driving lines, and the sensing driver is configured to generate compensation signals according to the electrical parameters, and transmit the compensation signals to the pixel circuits of the plurality of sub-pixels through the plurality of sensing driving lines.

For example, a display panel according to an embodiment further comprises a plurality of data lines connected with the pixel circuits of the plurality of sub-pixels, and each of the data lines is connected with pixel circuits of at least two sub-pixels in a same row.

For example, a display panel according to an embodiment further comprises a plurality of gate lines connected with the pixel circuits of the plurality of sub-pixels, and pixel circuits of the sub-pixels in each row are connected with a same gate line.

For example, a display panel according to an embodiment further comprises a plurality of gate lines connected with the pixel circuits of the plurality of sub-pixels, pixel circuits of the sub-pixels in a (2m−1)th row and pixel circuits of the sub-pixels in a (2m)th row are connected with a same gate line, and m is an integer greater than zero.

For example, in a display panel according to an embodiment, the plurality of data lines extend in a same direction as the plurality of sensing driving lines.

For example, in a display panel according to an embodiment, only the data line or only the sensing driving line is arranged between pixel circuits of every two columns of the sub-pixels.

For example, in a display panel according to an embodiment, the plurality of data lines are formed in the same layer as the plurality of sensing driving lines.

For example, in a display panel according to an embodiment, pixel circuits of the sub-pixels in a (2n−1)th column and pixel circuits of the sub-pixels in a (2n)th column are connected with a same data line, and n is an integer greater than zero.

For example, in a display panel according to an embodiment, the pixel circuit further comprises: a light emitting driving circuit, configured to drive the light emitting element to emit light during operation, and a sensing diving control circuit, configured to control connection and disconnection of the sensing driving line with the light emitting driving circuit in the pixel circuit.

For example, in a display panel according to an embodiment, the light emitting driving circuit comprises a first transistor, a second transistor and a storage capacitor. A first electrode of the first transistor is connected with a first power supply line to receive a first power supply voltage, a gate electrode of the first transistor is connected with a first node, and a second electrode of the first transistor is connected with a second node; a first electrode of the second transistor is connected with the data line to receive a data signal, a gate electrode of the second transistor is connected with a gate line to receive a gate driving signal, and a second electrode of the second transistor is connected with the first node; a first end of the storage capacitor is connected with the first node, and a second end of the storage capacitor is connected with the second node.

For example, in a display panel according to an embodiment, the sensing diving control circuit comprises a third transistor. A first electrode of the third transistor is connected with a second node, a gate electrode of the third transistor is connected with a sensing driving control line to receive a sensing driving control signal, and a second electrode of the third transistor is connected with the sensing driving line.

For example, a display panel according to an embodiment further comprises: a data driver, configured to provide data signals to the pixel circuits; and a scan driver, configured to provide gate driving signals to the pixel circuits.

For example, in a display panel according to an embodiment, the light emitting element is an organic light emitting diode, the electrical parameters comprise a light emitting current or a light emitting voltage of the organic light emitting diode, and the compensation signals comprise a compensation voltage or a compensation current.

At least one embodiment of the present disclosure provides a display device, comprising any one of the above-described display panels.

At least one embodiment of the present disclosure provides a compensating method of any one of the above-described display panels, comprising: sensing the electrical parameters of the light emitting elements through the sensing driving lines; generating the compensation signals according to the electrical parameters; and transmitting the compensation signals to the pixel circuits through the sensing driving lines.

For example, a compensating method according to at least one embodiment, before sensing the electrical parameters of the light emitting elements, further comprising: transmitting data signals to the pixel circuits through the data lines.

At least one embodiment of the present disclosure provides a display panel, and the display panel comprises a plurality of sub-pixels arranged in rows and columns, a plurality of data lines connected to the plurality of sub-pixels, and a plurality of sensing driving lines connected to the plurality of sub-pixels, each of the sub-pixels comprises a pixel circuit; the plurality of sub-pixels constitute a plurality of pixel units, the plurality of pixel units are arranged in a plurality of rows and a plurality of columns, and each of the plurality of pixel units comprises four sub-pixels; pixel circuits of the four sub-pixels are connected to a same data line of the plurality of data lines; and the pixel circuits of the four sub-pixels are connected to four sensing driving lines of the plurality of sensing driving lines in a one-to-one correspondence manner.

For example, in a display panel according to an embodiment, in each of the plurality of pixel units, the four sub-pixels are arranged in two rows and two columns.

For example, in a display panel according to an embodiment, the four sensing driving lines comprises a first sensing driving line, a second sensing driving line, a third sensing driving line, and a fourth sensing driving line, in each of the plurality of pixel units, the four sub-pixels comprise a first sub-pixel located in a first row and a first column, a second sub-pixel located in the first row and a second column, a third sub-pixel located in a second row and the first column, and a fourth sub-pixel located in the second row and the second column, in pixel units located in a same column, all first sub-pixels are connected to the first sensing driving line, all second sub-pixels are connected to the second sensing driving line, and all third sub-pixels are connected to the third sensing driving line, and all fourth sub-pixels are connected to the fourth sensing driving line.

For example, in a display panel according to an embodiment, the first sub-pixel is a red sub-pixel, the second sub-pixel is a green sub-pixel, the third sub-pixel is a blue sub-pixel, and the fourth sub-pixel is a white sub-pixel.

For example, in a display panel according to an embodiment, pixel circuits of sub-pixels of pixel units located in a same column are connected to a same data line.

For example, a display panel according to an embodiment further comprises a sensing driver connected with the plurality of sensing driving lines, the pixel circuit comprises a light emitting element, the sensing driver is configured to sense electrical parameters of light emitting elements of pixel circuits of the plurality of sub-pixels through the plurality of sensing driving lines, and the sensing driver is configured to generate compensation signals according to the electrical parameters, and transmit the compensation signals to the pixel circuits of the plurality of sub-pixels through the plurality of sensing driving lines.

For example, a display panel according to an embodiment further comprises a plurality of gate lines connected with pixel circuits of the plurality of sub-pixels, pixel circuits of sub-pixels in a same row are connected with a same gate line among the plurality of gate lines.

For example, a display panel according to an embodiment further comprises a plurality of gate lines connected with the pixel circuits of the plurality of sub-pixels, pixel circuits of the sub-pixels in a (2m−1)th row and pixel circuits of the sub-pixels in a (2m)th row are connected with a same gate line, and m is an integer greater than zero.

For example, in a display panel according to an embodiment, the plurality of data lines extend in a same direction as the plurality of sensing driving lines.

For example, in a display panel according to an embodiment, only one of the plurality of data lines or only one of the plurality of sensing driving lines is arranged between pixel circuits of every adjacent two columns of the plurality of sub-pixels.

For example, in a display panel according to an embodiment, the plurality of data lines are formed in a same layer as the plurality of sensing driving lines.

For example, in a display panel according to an embodiment, pixel circuits of sub-pixels of pixel units located in a same column are connected to a same data line, and the pixel circuits of the sub-pixels of the pixel units located in the same column are connected to four sensing driving lines.

For example, in a display panel according to an embodiment, the pixel circuit further comprises: a light emitting element; a light emitting driving circuit, configured to drive the light emitting element to emit light during operation, and a sensing diving control circuit, configured to control connection and disconnection of the sensing driving line with the light emitting driving circuit in the pixel circuit.

For example, in a display panel according to an embodiment, the light emitting driving circuit comprises a first transistor, a second transistor and a storage capacitor, a first electrode of the first transistor is connected with a first power supply line to receive a first power supply voltage, a gate electrode of the first transistor is connected with a first node, and a second electrode of the first transistor is connected with a second node; a first electrode of the second transistor is connected with a data line, corresponding to the pixel circuit, in the plurality of data lines to receive a data signal, a gate electrode of the second transistor is connected with a gate line to receive a gate driving signal, and a second electrode of the second transistor is connected with the first node; and a first end of the storage capacitor is connected with the first node, and a second end of the storage capacitor is connected with the second node.

For example, in a display panel according to an embodiment, the sensing diving control circuit comprises a third transistor, a first electrode of the third transistor is connected with the second node, a gate electrode of the third transistor is connected with a sensing driving control line to receive a sensing driving control signal, and a second electrode of the third transistor is connected with a sensing driving line, corresponding to the pixel circuit, among the plurality of sensing driving control lines.

For example, a display panel according to an embodiment further comprises: a data driver, configured to provide data signals to pixel circuits of the plurality of sub-pixels; and a scan driver, configured to provide gate driving signals to the pixel circuits of the plurality of sub-pixels.

For example, in a display panel according to an embodiment, the light emitting element is an organic light emitting diode, the electrical parameters comprise a light emitting current or a light emitting voltage of the organic light emitting diode, and the compensation signals comprise a compensation voltage or a compensation current.

At least one embodiment of the present disclosure provides a display device, comprising a display panel, the display panel comprises: a plurality of sub-pixels arranged in rows and columns, a plurality of data lines connected to the plurality of sub-pixels, and a plurality of sensing driving lines connected to the plurality of sub-pixels, each of the sub-pixels comprises a pixel circuit; the plurality of sub-pixels constitute a plurality of pixel units, the plurality of pixel units are arranged in a plurality of rows and a plurality of columns, and each of the plurality of pixel units comprises four sub-pixels; pixel circuits of the four sub-pixels are connected to a same data line of the plurality of data lines; and the pixel circuits of the four sub-pixels are connected to four sensing driving lines of the plurality of sensing driving lines in a one-to-one correspondence manner.

At least one embodiment of the present disclosure provides a compensating method of a display panel, the display panel comprises: a plurality of sub-pixels arranged in rows and columns, a plurality of data lines connected to the plurality of sub-pixels, and a plurality of sensing driving lines connected to the plurality of sub-pixels, each of the sub-pixels comprises a pixel circuit and a light emitting element; the plurality of sub-pixels constitute a plurality of pixel units, the plurality of pixel units are arranged in a plurality of rows and a plurality of columns, and each of the plurality of pixel units comprises four sub-pixels; pixel circuits of the four sub-pixels are connected to a same data line of the plurality of data lines; and the pixel circuits of the four sub-pixels are connected to four sensing driving lines of the plurality of sensing driving lines in a one-to-one correspondence manner, the compensating method comprises: sensing the electrical parameters of light emitting elements of the plurality of sub-pixels through the plurality of sensing driving lines; generating the compensation signals according to the electrical parameters; and transmitting the compensation signals to pixel circuits of the plurality of sub-pixels through the plurality of sensing driving lines.

For example, a compensating method according to at least one embodiment, before sensing the electrical parameters of the light emitting elements, further comprises: transmitting data signals to the pixel circuits through the plurality of data lines.

BRIEF DESCRIPTION OF THE DRAWINGS

In order to clearly illustrate the technical solution of the embodiments of the disclosure, the drawings used in the embodiments or description of related technologies will be briefly described in the following; it is obvious that the described drawings are only related to some embodiments of the disclosure and thus are not limitative of the disclosure.

DETAILED DESCRIPTION

Figure 1:
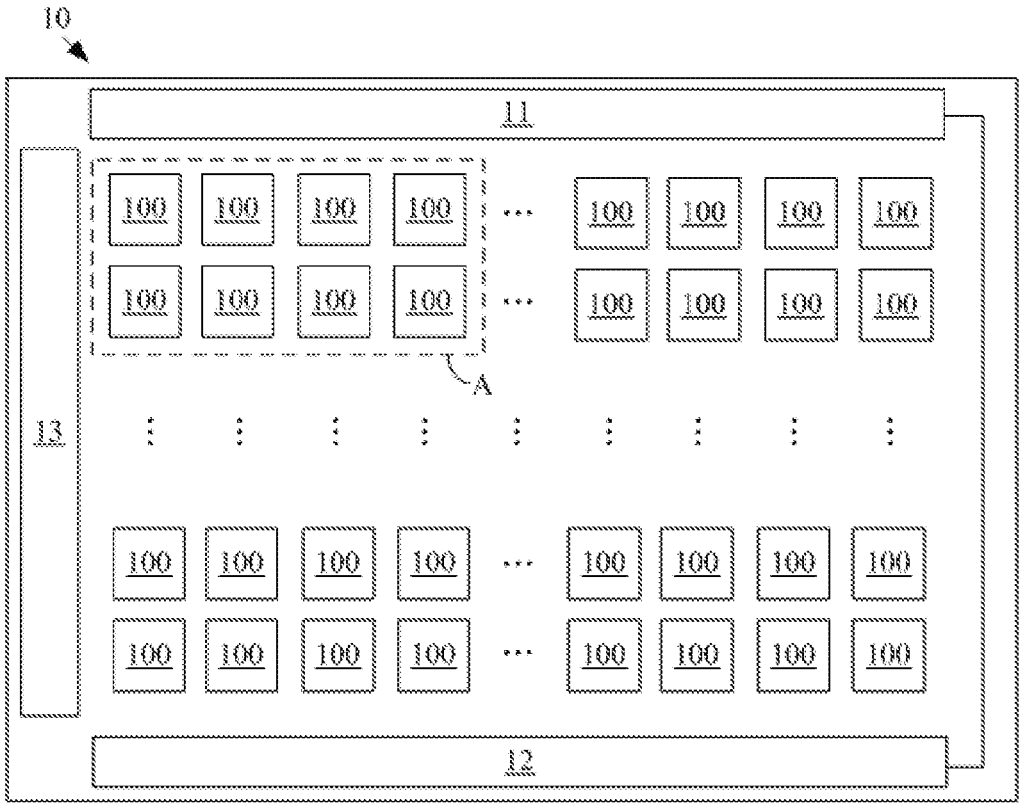
FIG. 1 is a schematic diagram of a display panel provided by an embodiment of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

For example, in an organic light emitting diode (OLED) display panel, the threshold voltages of the driving transistors in respective pixel circuits may differ from each other due to a manufacturing process. Furthermore, due to the influence of, for example, temperature variation, the threshold voltages of the driving transistors also suffer from drift phenomenon. Thus, the difference among the threshold voltages of the driving transistors may also result in non-uniform display of the display panel. Therefore, it is necessary to compensate the threshold voltages of the driving transistors.

For the pixel circuits in the display panel, the threshold compensation for the driving transistors in the pixel circuits can be realized by sensing light emitting currents or light emitting voltages of the organic light emitting diodes. When the above-described compensating method is adopted, it is necessary to provide sensing lines. Parasitic capacitance occurs between the sensing lines and other lines (for example, gate lines or data lines), thereby increasing the RC load of the circuits and reducing the sensing speed, which can easily lead to an insufficient sensing time period.

On the other hand, an aperture ratio of the display panel can affect the brightness of the display panel. Therefore, how to increase the aperture ratio of the display panel is also a problem to be solved.

A display panel, a display device and a compensating method provided by at least one embodiment of the present disclosure can increase the aperture ratio and reduce the parasitic capacitance by sharing data lines among the four pixel circuits of the same pixel unit, and perform the operation of sensing on the light emitting currents or the light emitting voltages of the organic light emitting diodes by sharing sensing driving lines and compensating for the threshold voltage drift of the driving transistors. In addition, the pixel circuits in the same pixel unit are respectively connected to different sensing driving lines, thereby improving the sensing accuracy of the threshold voltage and the compensation accuracy of the threshold voltage.

At least one embodiment of the present disclosure provides a display panel, and the display panel includes: a plurality of sub-pixels arranged in rows and columns, each of the sub-pixels comprising a pixel circuit; a plurality of sensing driving lines respectively connected with pixel circuits of the plurality of sub-pixels; and a sensing driver connected with the plurality of sensing driving lines. The pixel circuit includes a light emitting element, the sensing driver is configured to sense electrical parameters of light emitting elements of the pixel circuits of the plurality of sub-pixels through the plurality of sensing driving lines, and the sensing driver is configured to generate compensation signals according to the electrical parameters, and transmit the compensation signals to the pixel circuits of the plurality of sub-pixels through the plurality of sensing driving lines.

At least one embodiment of the present disclosure provides a display panel, and the display panel includes: a plurality of sub-pixels arranged in an array, each of the sub-pixels include a pixel circuit; sensing driving lines connected with pixel circuits; data lines each connected with at least two pixel circuits in a same row; and a sensing driver connected with the sensing driving lines. The pixel circuit includes an organic light emitting diode, the sensing driver is configured to sense a light emitting current or a light emitting voltage of the organic light emitting diode, and the sensing driver is configured to generate a compensation voltage according to the light emitting current or the light emitting voltage, and transmit the compensation voltage to the pixel circuit through the sensing driving line.

For example, sensing the light emitting current of the light emitting element (for example, an organic light emitting diode) refers to sense the light emitting current that is about to flow through or is flowing through the organic light emitting diode; sensing the light emitting voltage of the light emitting element (for example, an organic light emitting diode) refers to sense the voltage of an anode when the organic light emitting diode is emitting light.

In the following, the display panel is described with an organic light emitting diode display panel as an example, but embodiments of the present disclosure are not limited thereto. For example, the light emitting element can also be other kind of electroluminescent element such as an inorganic light emitting diode.

Figure 2:
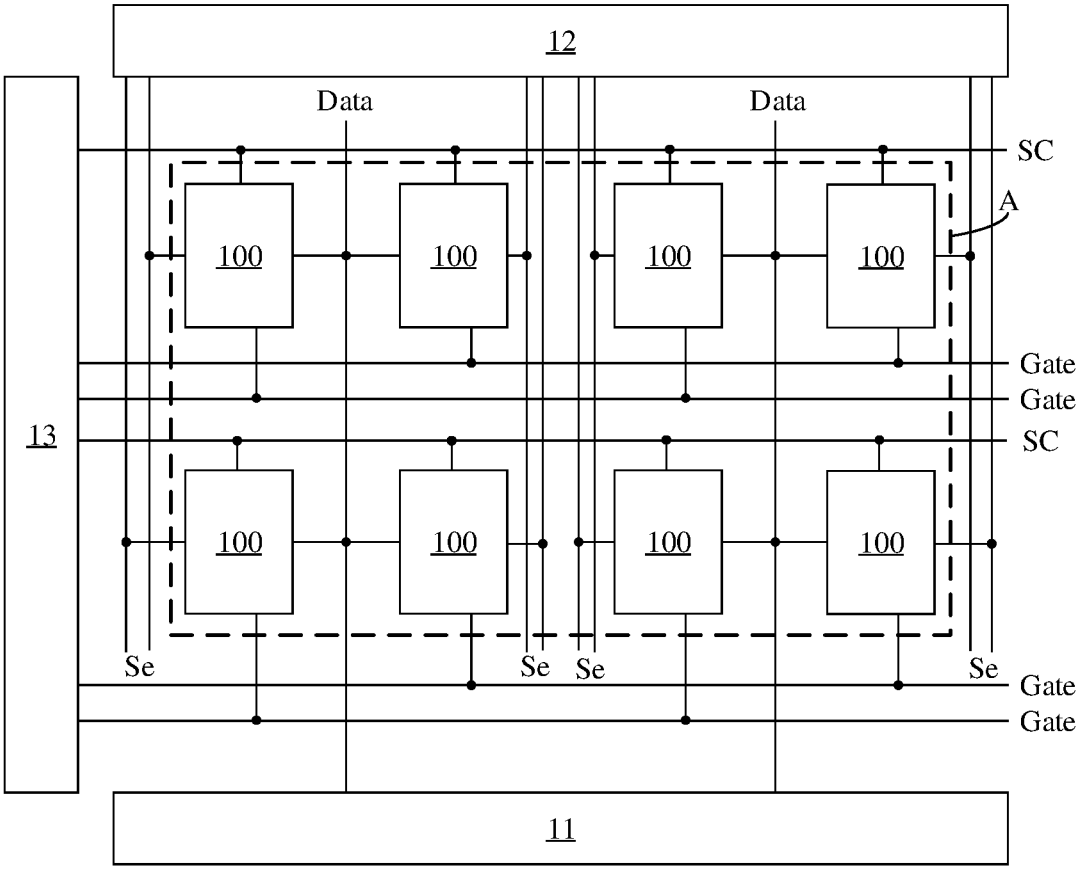
FIG. 2 is a first schematic diagram of the connection relationship between pixel circuits in the region A of FIG. 1 provided by the embodiment of the present disclosure.

For example, FIG. 1 is a schematic diagram of a display panel provided by an embodiment of the present disclosure; FIG. 2 is a first schematic diagram of the connection relationship between pixel circuits in the region A of FIG. 1 provided by the embodiment of the present disclosure.

For example, as shown in FIG. 1 and FIG. 2, a display panel 10 provided by an embodiment of the present disclosure includes a plurality of sub-pixels arranged in an array, and the sub-pixels are arranged in rows and columns. The sub-pixels can be arranged in regular rows and columns, that is, the sub-pixels are all aligned with each other in the row and column directions, and can also be arranged in irregular rows and columns, for example, two adjacent rows or two adjacent columns can shift from each other by a predetermined distance (for example, half the width or height of a sub-pixel), which is not limited by the embodiments of the present disclosure. Each sub-pixel includes a pixel circuit 100, and the pixel circuit 100 includes a light emitting element such as an organic light emitting diode. The display panel 10 further includes a data driver 11, a sensing driver 12, a scan driver 13, data lines Data, gate lines Gate, and sensing driving lines Se. In FIG. 1 and FIG. 2, the plurality of data lines Data extend parallel to each other and extend longitudinally, the plurality of gate lines Gate extend parallel to each other and extend laterally, and the plurality of sensing driving lines Se extend parallel to each other and extend longitudinally.

For example, the data driver 11 is configured to provide data signals to the pixel circuits 100. The sensing driver 12 is configured to sense electrical parameters of light emitting elements (for example, organic light emitting diodes) through the sensing driving lines Se, and the electrical parameters, for example, are light emitting currents or light emitting voltages of the light emitting elements. The sensing driver 12 is also configured to generate compensation signals according to the sensed light emitting currents or light emitting voltages, and transmit the compensation signals to the pixel circuits 100 through the sensing driving lines Se. For example, the compensation signals are compensation currents or compensation voltages. The scan driver 13 is configured to provide gate driving signals to the pixel circuits 100.

For example, each data line Data is connected with pixel circuits 100 of at least two sub-pixels in a same row and the data driver 11. The data driver 11 is configured to provide data signals to the pixel circuits 100 of at least two sub-pixels in the same row through the same data line Data.

For example, in a display panel provided by at least one embodiment of the present disclosure, the sensing driver 12 can sense electrical parameters (light emitting currents or light emitting voltages) of light emitting elements in the pixel circuits 100 of sub-pixels through the sensing driving lines Se. The sensing driver 12 can also generate compensation signals (for example, compensation currents or compensation voltages) according to the sensed electrical parameters, and transmit the compensation signals to the pixel circuits 100 through the sensing driving lines Se, thereby controlling luminous intensity of the light emitting elements.

For example, at least some of the P sub-pixels, which are connected to the same data line Data, in the same row are connected to different sensing driving lines Se, and P is a positive integer greater than or equal to 2. For example, as shown in FIG. 2, two sub-pixels in the same row are connected to the same data line Data, in this case, the two sub-pixels are respectively connected to two different sensing driving lines Se. For another example, if the four sub-pixels in the same row shown in FIG. 2 are all connected to the same data line Data, in this case, the four sub-pixels are respectively connected to four different sensing driving lines Se.

For example, the data driver 11, the sensing driver 12 and the scan driver 13 can be respectively implemented by an application-specific integrated circuit chip and can also be implemented by a circuit or software, hardware (circuit), firmware or any combination thereof. For example, in at least one embodiment, the data driver 11 and the sensing driver 12 can be implemented by same one integrated circuit chip. The scan driver 13 is implemented by a GOA (gate on array) gate driving circuit and thus can be directly fabricated on the display panel. The scan driver 13 can also be implemented by an integrated circuit chip and then electrically connected with gate lines through a printed circuit board (for example, a flexible printed circuit board) or the like.

Moreover, for example, the sensing driver 12 can include a processor and a memory. In the embodiments of the present disclosure, the processor can process data signals and can include a variety of computational structures, e.g., a complex instruction set computer (CISC) structure, a reduced instruction set computing (RISC) structure or a structure that incorporates a plurality of instruction set combinations. In some embodiments, the processor can also be a microprocessor, e.g., an X86 processor or an ARM processor, and can also be a digital signal processor (DSP), etc. The processor can control other components to execute desired functions. In the embodiments of the present disclosure, the memory can store instructions and/or data executed by the processor. For example, the memory can include one or more computer program products. The computer program products can include various kinds of computer readable storage media, e.g., volatile memory and/or nonvolatile memory. Volatile memory, for example, includes a random access memory (RAM) and/or a cache memory. Nonvolatile memory, for example, includes read-only memory (ROM), hard disk, flash memory, etc. One or more computer program instructions can be stored in the computer readable storage medium. The processor can execute the program instructions to realize the desired functions (implemented by the processor) in the embodiments of the present disclosure. Various applications and various data, e.g., data used and/or produced by the applications, can also be stored in the computer readable storage media.

For example, the display panel 10 further includes a controller (not shown in figures), the controller is coupled with the data driver 11, the sensing driver 12 and the scan driver 13, and is configured to provide control instructions and/or timing signals to the data driver 11, the sensing driver 12 and the scan driver 13, whereby the data driver 11, the sensing driver 12 and scan driver 13 cooperate with each other. For example, the controller can also be implemented by a circuit or software, hardware (circuit), firmware or any combination thereof. For example, the controller is a timing controller (T-CON) for receiving image data inputted from outside of the display panel, providing decoded image data to the data driver, and outputting scan control signals and data control signals to the gate driver and the data driver.

For example, the data driver 11 and the sensing driver 12 can be connected together to facilitate data interaction between the sensing driver 12 and the data driver 11.

For example, in a display panel provided by at least one embodiment of the present disclosure, the pixel circuit 100 of the (2n−1)th column sub-pixels and the pixel circuit 100 of the (2n)th column sub-pixels in a same row are connected with a same data line Data, and n is an integer greater than zero.

For example, as shown in FIG. 2, two pixel circuits 100 connected to the same data line Data in the same row are respectively connected with two different gate lines Gate. For another example, in the same row, the pixel circuits 100 of the sub-pixels in the (2n−1)th column are connected with a gate line Gate, and the pixel circuits 100 of the sub-pixels in the adjacent (2n)th column are connected with another gate line Gate, and the two gate lines can be arranged adjacent to each other, for example, arranged between two adjacent rows of sub-pixels. This arrangement enables the pixel circuits 100 of the sub-pixels in the (2n−1)th column and the pixel circuits 100 of the sub-pixels in the adjacent (2n)th column to be turned on in a time-sharing manner. Therefore, it is convenient to use the common data line Data to provide different data signals for the pixel circuits 100 sharing the data line Data.

For example, as shown in FIG. 2, the display panel 10 further includes sensing driving control lines SC, and the sensing driving control lines SC are connected with the scan driver 13. The sensing driving control lines SC and the gate lines Gate can share the scan driver 13, that is, the scan driver 13 can provide sensing driving control signals and gate driving signals for the sensing driving control lines SC and the gate lines Gate, respectively.

Figure 3:
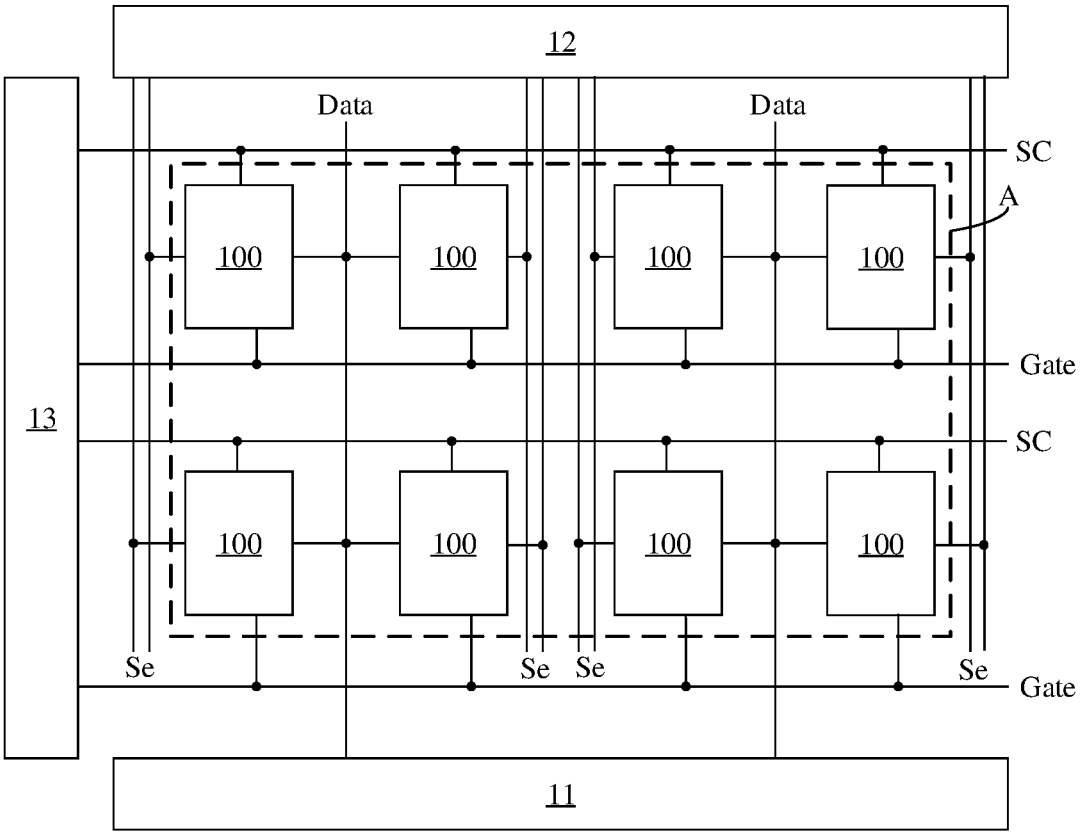
FIG. 3 is a second schematic diagram of the connection relationship between pixel circuits in the region A of FIG. 1 provided by the embodiment of the present disclosure.

For example, as shown in FIG. 3, in a display panel provided by an embodiment of the present disclosure, the pixel circuits 100 of each row of sub-pixels can be connected with a same gate line Gate. This arrangement enables the pixel circuits 100 of the same row to be turned on at the same time, and the common data line Data provides the same data signal to the pixel circuits 100, which shares the data line Data, in the same row. In this case, the light emitting luminance of the organic light emitting diodes in the pixel circuits 100 sharing the data line Data can be controlled by the compensation voltages transmitted from the sensing driving lines Se to the pixel circuits 100, and a specific compensation process will be described later in detail. Compared with the arrangement as shown in FIG. 2, the arrangement as shown in FIG. 3 reduces the number of gate lines Gate (the number of gate lines Gate is reduced, for example, to a half of the arrangement as shown in FIG. 2), thereby further increasing the aperture ratio of the display panel, reducing parasitic capacitance, and facilitating wiring and production of the display panel.

Figure 4:
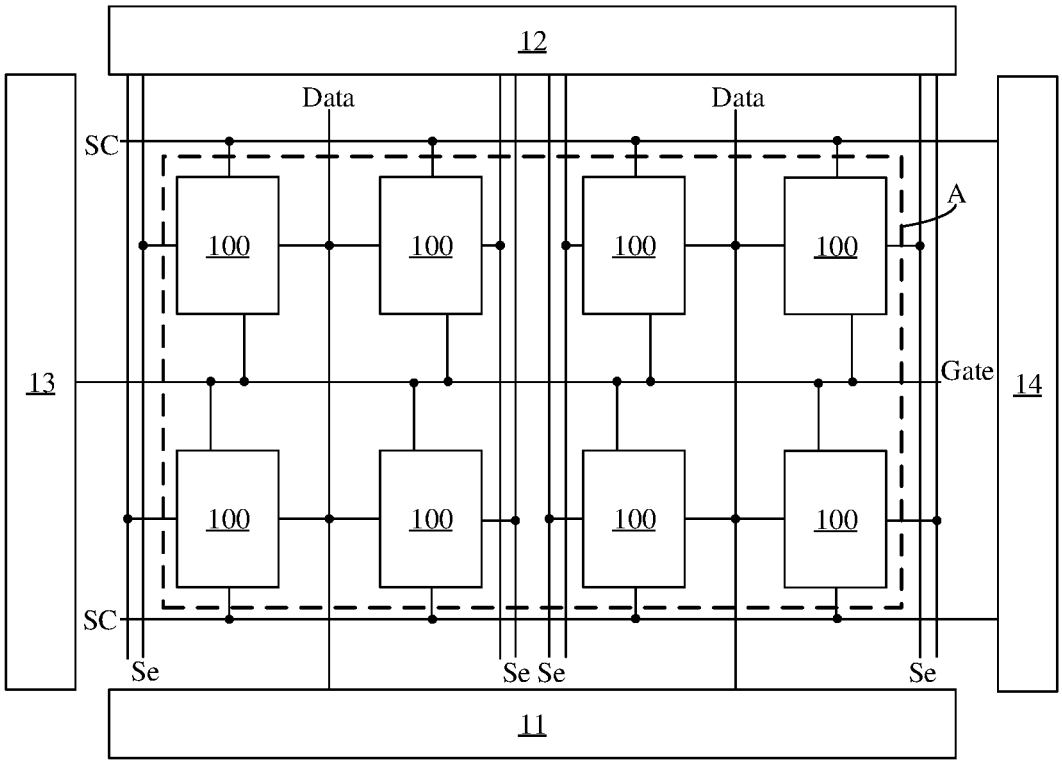
FIG. 4 is a third schematic diagram of the connection relationship between pixel circuits in the region A of FIG. 1 provided by the embodiment of the present disclosure.

For example, as shown in FIG. 4, in a display panel provided by at least one embodiment of the present disclosure, pixel circuits of the sub-pixels in the (2m−1)th row and pixel circuits of the sub-pixels in the (2m)th row are connected with a same gate line, and m is an integer greater than zero. This arrangement enables the pixel circuits 100 of the sub-pixels in the (2m−1)th row and the pixel circuits 100 of the sub-pixels in the (2m)th row to be turned on at the same time, and the common data line Data provides the same data signal to pixel circuits 100, which shares the data line Data, in two rows and two adjacent columns. The light emitting luminance of the organic light emitting diodes in the pixel circuits 100 sharing the data line Data can be controlled by the compensation voltages transmitted from the sensing driving lines Se to the pixel circuits 100, and a specific compensation process will be described later in detail. Compared with the arrangements of the embodiments shown in FIG. 2 and FIG. 3, the arrangement of the embodiment shown in FIG. 4 reduces the number of gate lines Gate (the number of gate lines Gate is reduced, for example, to a quarter of the arrangement as shown in FIG. 2), thereby further increasing the aperture ratio of the display panel, reducing the parasitic capacitance, and facilitating wiring and production of the display panel. In other words, the display panel can also adopt a double-row scanning manner, that is, two rows of pixel circuits are simultaneously in a charged state at any time, and each pixel circuit can be provided twice as much charging time as the original progressive scan driving manner, which ensures display quality of picture, especially for large-size, high-resolution OLED display products.

For example, the sensing driving control lines SC and the gate lines Gate are not limited to the case of sharing the scan driver 13. As shown in FIG. 4, in at least one embodiment, the display panel 10 further includes a sensing driving control circuit 14 independent of the scan driver 13, the sensing driving control lines SC are connected with the sensing driving control circuit 14, and the sensing driving control circuit 14 can provide the sensing driving control signals for the sensing driving control lines SC. As shown in FIG. 4, the scan driver 13 and the sensing driving control circuit 14 are located on two sides of the sub-pixel array, respectively, and the scan driver 13 and the sensing driving control circuit 14 can also be located on a same side.

For example, the sub-pixels located in the same column are connected to at least two sensing driving lines Se. In some embodiments, the sub-pixels located in the same column are connected to two sensing driving lines Se, for example, in the same column, the pixel circuits of the sub-pixels in the odd-numbered rows are connected to one of the two sensing driving lines Se, and the pixel circuits of the sub-pixels in the even-numbered rows are connected to the other of the two sensing driving lines Se. As shown in FIG. 2, the sub-pixel located in the first column and the first row and the sub-pixel located in the first column and the second row are respectively connected to two sensing driving lines Se.

For example, in some embodiments, as shown in FIG. 4, the pixel circuits 100 in different rows and in the same column share a sensing driving line Se, for example, in the same column, the pixel circuits of the sub-pixels in the odd-numbered rows are connected to one of the two sensing driving lines Se, and the pixel circuits of the sub-pixels in the even-numbered rows are connected to the other of the two sensing driving lines Se, in this case, for the pixel circuits 100 in different rows and in the same column, the pixel circuits 100 in different rows and in the same column can be controlled to be connected to the sensing driving line Se in a time-sharing manner through the sensing driving control lines SC, so as to achieve to transmit different compensation voltages to the pixel circuits 100 in different rows and in the same column through the sensing driving line Se. For example, in a case where the pixel circuit of the sub-pixel in the first row and the pixel circuit of the sub-pixel in the third row are connected to the same sensing driving line Se, in this case, the pixel circuit 100 of the sub-pixel in the first row and the pixel circuit 100 of the sub-pixel in the third row can be controlled by the sensing driving control line SC to be connected with the sensing driving line Se in a time-sharing manner, so as to achieve to transmit different compensation voltages to the pixel circuit 100 of the sub-pixel in the first row and the pixel circuit 100 of the sub-pixel in the third row through the sensing driving line Se.

For example, because the pixel circuits 100 in different rows and in the same column in the embodiment as shown in FIG. 4 are respectively connected to different sensing driving lines Se, so as to achieve to transmit different compensation voltages to the pixel circuits 100 in different rows and in the same column. As shown in FIG. 2 to FIG. 4, the pixel circuits 100 in the same row may be connected to the same sensing driving control line SC. Embodiments of the present disclosure are not limited thereto. In other embodiments, the pixel circuits 100 in different rows and in the same column can also share the sensing driving control line SC. For example, the pixel circuits of the sub-pixels in a (2i−1)-th row and the pixel circuits of the sub-pixels in a (2i)-th row can be controlled by the same sensing driving control line SC, and i is an integer greater than 0. For example, the pixel circuit of the sub-pixel in the first row and the pixel circuit of the sub-pixel in the second row are connected to the same sensing driving control line SC, and the pixel circuit of the sub-pixel in the third row and the pixel circuit of the sub-pixel in the fourth row are connected to the same sensing drive control line SC, and so on.

For example, as shown in FIG. 2 to FIG. 4, in a display panel provided by at least one embodiment of the present disclosure, the data lines Data extend in a same direction as the sensing driving lines Se. This arrangement can facilitate the setting of the data driver 11 and the sensing driver 12 while avoiding overlap of the data lines Data and the sensing driving lines Se, thereby reducing the parasitic capacitance.

For example, as shown in FIG. 2 to FIG. 4, in a display panel provided by at least one embodiment of the present disclosure, only one of the data lines Data or one of the sensing driving lines Se is disposed between the pixel circuits 100 of every two columns sub-pixels. This arrangement can reduce the mutual influence between the data lines Data and the sensing driving lines Se, further reduce the parasitic capacitance and improve the display quality.

For example, in a display panel provided by at least one embodiment of the present disclosure, the data lines Data are formed in the same layer as the sensing driving lines Se. In other words, the data lines Data and the sensing driving lines Se can be formed by using a same patterning process and using a same material layer, which can reduce the number of patterning processes (that is, reduce the usage amount of masks), simplify the production process and reduce the cost.

For example, a display panel 10 provided by at least one embodiment of the present disclosure further includes a first power supply line (not shown in figures), and the first power supply line is configured to provide first power supply voltages VDD to the plurality of pixel circuits 100.

For example, the display panel 10 further includes a second power supply line (not shown in figures), and the second power supply line is configured to provide second power supply voltages VSS to the plurality of pixel circuits 100. For example, the second power supply line can be connected with a cathode of the OLED.

For example, the first power supply voltage VDD can be a high level voltage (for example, 5V), and the second power supply voltage VSS can be a low level voltage (for example 0V or connected with the ground).

Figure 5:
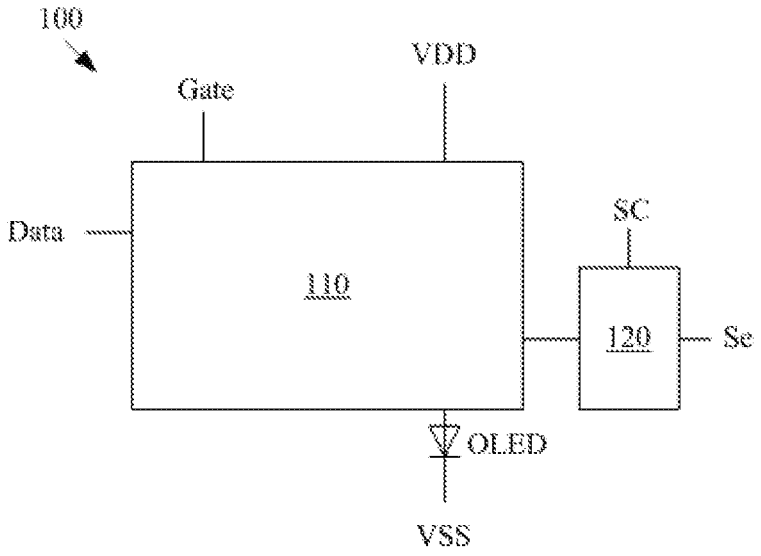
FIG. 5 is a first schematic diagram of a pixel circuit in a display panel provided by the embodiment of the present disclosure.

For example, as shown in FIG. 5, in a display panel provided by at least one embodiment of the present disclosure, the pixel circuit further includes a light emitting driving circuit 110 and a sensing diving control circuit 120. The light emitting driving circuit 110 is configured to drive the OLED to emit light during operation. The sensing diving control circuit 120 is configured to control connection and disconnection of the sensing driving lines Se with the light emitting driving circuit 110 in the pixel circuit 100.

Figure 6A:
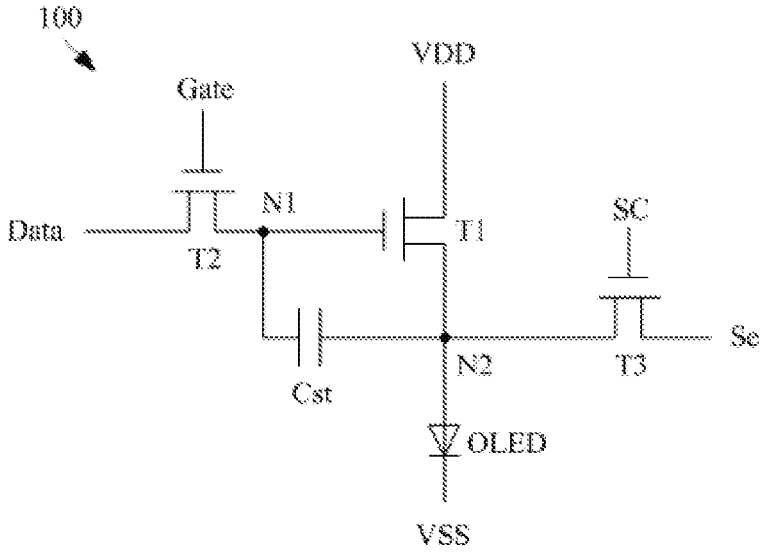
FIG. 6A is a second schematic diagram of a pixel circuit in a display panel provided by the embodiment of the present disclosure.

For example, as shown in FIG. 5 and FIG. 6A, in a display panel provided by at least one embodiment of the present disclosure, the light emitting driving circuit 110 includes a first transistor T1 (a driving transistor), a second transistor T2, and a storage capacitor Cst. A first electrode of the first transistor T1 is connected with the first power supply line to receive the first power supply voltage VDD, a gate electrode of the first transistor T1 is connected with a first node N1, and a second electrode of the first transistor T1 is connected with a second node N2. A first electrode of the second transistor T2 is connected with the data line Data to receive the data signal, a gate electrode of the second transistor T2 is connected with the gate line to receive the gate driving signal, and a second electrode of the second transistor T2 is connected with the first node N1. A first end of the storage capacitor Cst is connected with the first node N1, and a second end of the storage capacitor Cst is connected with the second node N2.

For example, the anode of the OLED is connected with the second node N2, and the cathode of the OLED is electrically connected with the second power supply voltage VSS, for example, is electrically connected with the second power supply voltage VSS through the second power supply line.

For example, as shown in FIG. 5 and FIG. 6A, in a display panel provided by at least one embodiment of the present disclosure, the sensing diving control circuit 120 includes a third transistor, a first electrode of the third transistor T3 is connected with the second node N2, a gate electrode of the third transistor T3 is connected with the sensing driving control line SC to receive the sensing driving control signal, and a second electrode of the third transistor T3 is connected with the corresponding sensing driving line Se.

Figure 6B:
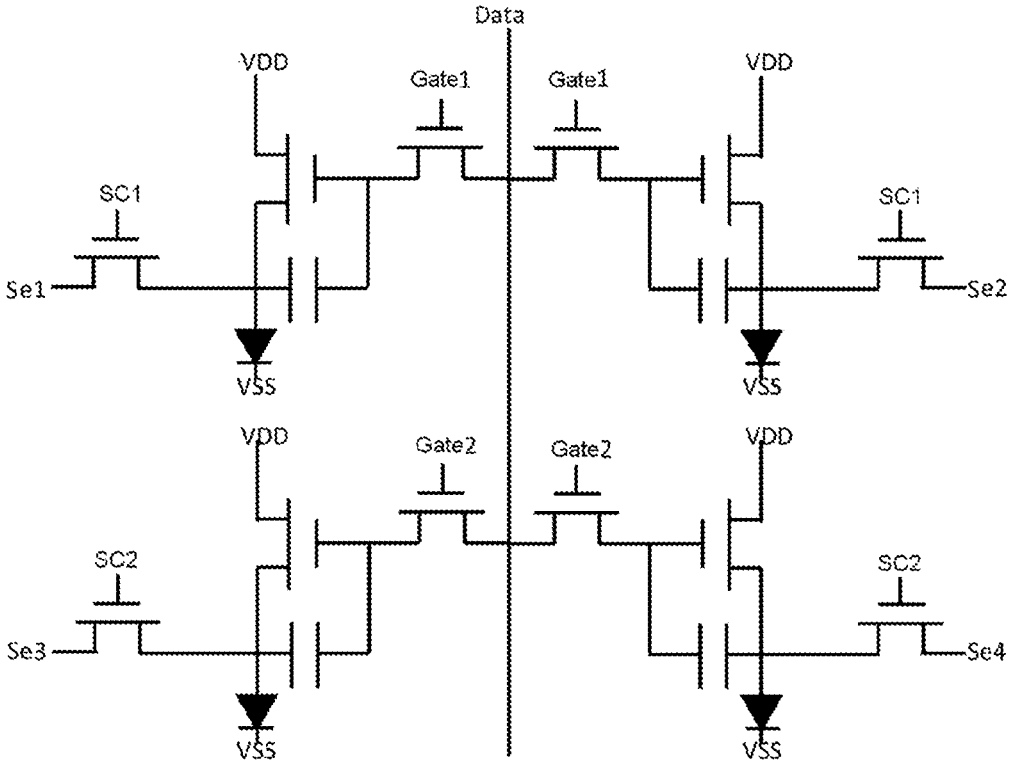
FIG. 6B is a third schematic diagram of a pixel circuit in a display panel provided by the embodiment of the present disclosure.

FIG. 6B shows four sub-pixels, and each sub-pixel adopts the pixel circuit as shown in FIG. 6A. For example, two sub-pixels adjacent to each other in the first row in the figure share a same data line Data, the two sub-pixels are connected with a same gate line Gate1 and a same sensing control line SC1, but each sub-pixel is connected with a different sensing line Se1 or Se2; two sub-pixels adjacent to each other in the second row in the figure are connected in a same manner. The sub-pixels in the left column of the figure share a same data line Data, they are connected with different gate lines Gate1 and Gate2, they are connected with different sensing control lines SC1 and SC2, and they are connected with different sensing lines Se1 and Se3 or connected with a same sensing line; the sub-pixels in the right column of the figure are connected in a same manner.

It should be noted that all the transistors adopted in the embodiments of the present disclosure can be TFTs, field-effect transistors (FETs) or other switching elements having same characteristics. A source electrode and a drain electrode of the transistor adopted herein can be symmetrical in structure, so the source electrode and the drain electrode of the transistor can have no difference in structure. In the embodiments of the present disclosure, in order to distinguish two electrodes except the gate electrode of the transistor, one electrode is directly described as the first electrode and the other electrode is directly described as the second electrode, so the first electrode and the second electrode of all or portion of the transistors in the embodiments of the present disclosure can be exchanged as required. For example, the first electrode of the transistor in the embodiments of the present disclosure can be the source electrode and the second electrode can be the drain electrode; or the first electrode of the transistor is the drain electrode and the second electrode is the source electrode. In addition, the transistors can be divided into N-type transistors and P-type transistors according to the characteristics of the transistors. The embodiments of the present disclosure do not limit the types of the transistors, and those skilled in the art can use the N-type and/or P-type transistors to implement the embodiments of the present disclosure according to actual requirements.

It should be noted that at least one embodiment of the present disclosure includes but is not limited to the pixel circuit as shown in FIG. 5 or FIG. 6A or FIG. 6B, and can also be a pixel circuit with other structure. For example, in at least one embodiment, the pixel circuit can further include other sub-circuits, such as a reset circuit for resetting the gate electrode of the first transistor, a light emitting control circuit for controlling light emitting of the organic light emitting diode, etc., for example, can further include a transistor, a capacitor and other device to achieve internal compensation and other functions, and details are not described herein again.

Figure 7:
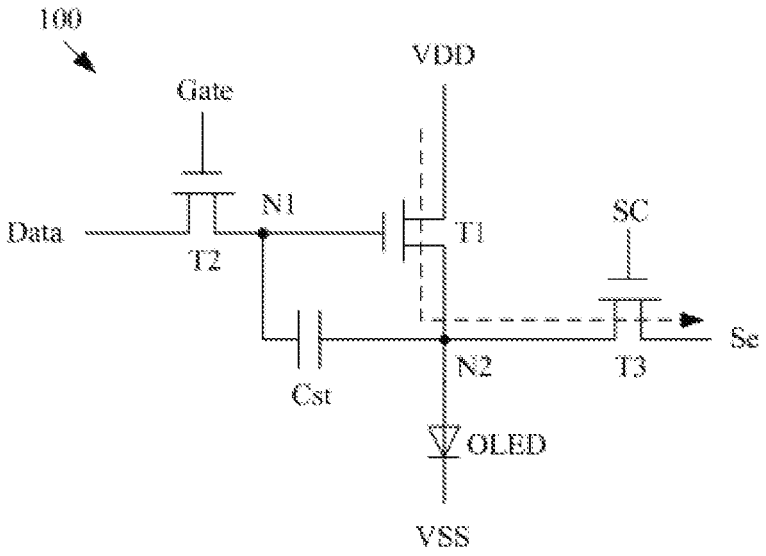
FIG. 7 is a schematic diagram of sensing a current flowing through a first transistor in the pixel circuit shown in FIG. 6A.
Figure 8:
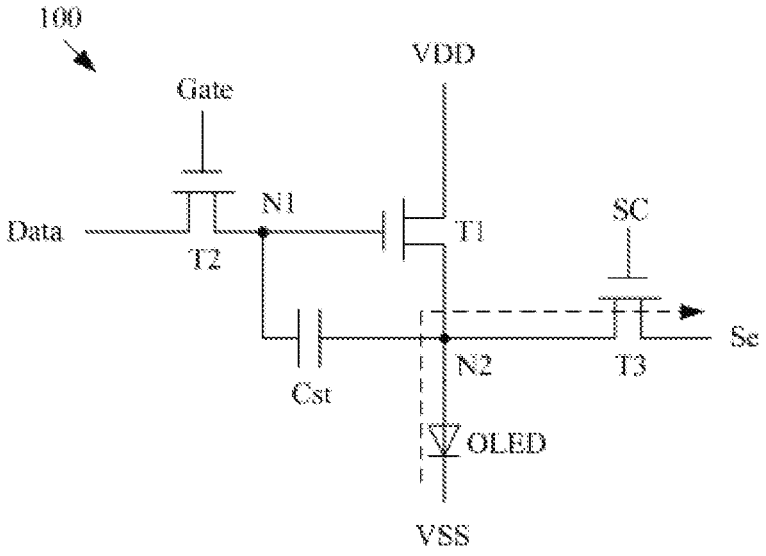
FIG. 8 is a schematic diagram of sensing a light emitting voltage of the organic light emitting diode in the pixel circuit shown in FIG. 6A.

For example, for the pixel circuit as shown in FIG. 6A, in a sensing stage of the organic light emitting diode, the third transistor T3 in the pixel circuit 100 is controlled to be turned on by the sensing driving control line SC, so that the sensing driver 12 senses the light emitting current or the light emitting voltage of the organic light emitting diode through the sensing driving line Se, and thus obtains the electrical parameters of the organic light emitting diode, including changes of the electrical parameters. For example, as shown in FIG. 7, when sensing the current flowing through the first transistor T1 (in a light emitting stage, the current flowing through the first transistor T1 is used for driving the OLED to emit light), the first transistor T1, the second transistor T2 and the third transistor T3 are turned on, and the OLED is turned off. For example, as shown in FIG. 8, when sensing the light emitting voltage of the OLED, the first transistor T1 is turned off, and the second transistor T2 and the third transistor T3 are both turned on, for example, the data signal is at a low level at this time. For example, when the light emitting current or the light emitting voltage sensed by the sensing driver 12 does not match a predetermined light emitting current or light emitting voltage of the pixel circuit, the sensing driver 12 generates the compensation voltage Vse or generates a compensation current according to the sensed light emitting current or the sensed light emitting voltage.

For example, in the light emitting stage, the compensation voltage Vse or the compensation current can be applied to the pixel circuit through the sensing driving line Se, for example, by a voltage source or a current source. For example, the light emitting current holed of the OLED satisfies the following saturation current equation:

$$\mathrm{Ioled}=K(Vgs-Vth)^2=K(V\mathrm{data}-Vse-Vth)^2$$

Where $$K=0.5\mu_n\mathrm{Cox}\frac{W}{L},$$

$\mu_n$ is the channel mobility of the first transistor T1, Cox is the channel capacitance per unit area of the first transistor T1, W and L are the channel width and the channel length of the first transistor T1 respectively, Vth is the threshold voltage of the first transistor T1, and Vgs is the gate-source voltage (difference between a gate electrode voltage and a source electrode voltage of the first transistor T1) of the first transistor T1 (the driving transistor). Because the data line Data is connected with the gate electrode of the first transistor T1, the gate electrode voltage of the first transistor T1 is the data voltage Vdata transmitted by the data line. Because the sensing driving line Se is connected with the source electrode of the first transistor T1 through the third transistor T3, when the third transistor T3 is turned on, the source electrode voltage of the first transistor T1 is the compensation voltage Vse transmitted by the sensing driving control line SC. From the above-described saturation current equation of the OLED, it can be seen that the light emitting current Ioled of the OLED is related to the channel mobility $\mu_n$, the data voltage Vdata transmitted by the data line, the compensation voltage Vse transmitted by the sensing driver 12 through the sensing driving line Se, and the threshold voltage Vth of the first transistor T1. Therefore, the influence of the threshold voltage Vth drift can be compensated by adjusting the magnitude of the compensation voltage Vse, thereby the light emitting current holed of the OLED can be the predetermined light emitting current.

In addition, when the channel mobility $\mu_n$ of the first transistor T1 drifts, the influence of the drift of the channel mobility $\mu_n$ can also be compensated by adjusting the magnitude of the compensation voltage Vse.

In addition, for example, in the embodiments as shown in FIG. 3 and FIG. 4, when the plurality of pixel circuits 100 sharing data lines Data and sharing gate lines Gate. For example, two pixel circuits in FIG. 3 share a same data line Data and a same gate line Gate; for enabling OLEDs in the two pixel circuits 100 to satisfy respective predetermined light emitting current, the sensing driver 12 can transmit the compensation voltages Vse corresponding to each sub-pixel to the two pixel circuits 100 through the different sensing driving lines that are connected with the two pixel circuits 100, and for example, the compensation voltages Vse can be different from each other. For example, in the embodiment as shown in FIG. 4, four pixel circuits share a same data line Data and a same gate line Gate; for enabling OLEDs in the four pixel circuits 100 to satisfy respective predetermined light emitting current, the sensing driver 12 can transmit the compensation voltages Vse corresponding to each sub-pixel to the four pixel circuits 100 through four sensing driving lines that are respectively connected with the four pixel circuits 100, and for example, the compensation voltages Vse can be different from each other. For example, because the pixel circuits 100 in different rows and in the same column as shown in FIG. 4 share a sensing driving line Se, the pixel circuits 100 in different rows and in the same column can control the third transistors T3 of the pixel circuits 100 in different rows and in the same column to be turned on in a time-sharing manner through the sensing driving control lines SC, so as to realize that transmitting different compensation voltages Vse to the pixel circuits 100 in different rows and in the same column through the sensing driving line Se.

For example, the embodiments of the present disclosure are not limited to the case of realizing compensate alone by the compensation voltage Vse transmitted through the sensing driving line Se, but also the data voltage Vdata transmitted through the data line and the compensation voltage Vse transmitted through the sensing driving line Se can be used together to compensate, thereby enabling the adjustable range of the gate-source voltage Vgs of the first transistor T1 to be wider. In this compensation manner, the data driver 11 and the sensing driver 12 can be connected together or both connected with a controller to work together, and to achieve compensation together. This can enable the compensation range to be wider and the compensation to be more accurate.

For example, the light emitting current of the OLED can be sensed in each frame of a display image, and each pixel circuit can be dynamically adjusted by adjusting the magnitude of the compensation voltage Vse or the compensation current, thereby improving display quality.

For example, when the sensed light emitting current or light emitting voltage is less than the predetermined light emitting current or light emitting voltage, the compensation voltage is reduced in one example, or the compensation current is increased in another example.

For example, when the sensed light emitting current or light emitting voltage is greater than the predetermined light emitting current or light emitting voltage, the compensation voltage is increased in one example, or the compensation current is reduced in another example.

For example, a function or a correspondence table between the compensation voltage Vse or the compensation current with the light emitting current Ioled of the OLED, the channel mobility $\mu_n$, the data voltage Vdata transmitted by the data line, and the threshold voltage Vth can be established, and the sensing driver 12 can transmit different compensation voltages Vse or compensation currents to the respective pixel circuits 100 through the sensing driving lines Se according to the function or the correspondence table. For example, the function or the correspondence table can be stored in a storage device for retrieval and use. The storage device can be any suitable type of storage device, such as a semiconductor memory or a magnetic memory.

For example, the sensing driver 12 sensing the light emitting current or the light emitting voltage of the organic light emitting diode through the sensing driving line Se is not limited to the light emitting stage of the organic light emitting diode, and a sensing stage different from the light emitting stage of the organic light emitting diode can also be set for sensing the light emitting current or the light emitting voltage of the organic light emitting diode.

For example, the sensing driver 12 can sense the light emitting current or the light emitting voltage of the organic light emitting diode through the sensing driving line Se in an initial period in the light emitting stage of the organic light emitting diode. For another example, after transmitting the data voltage Vdata to the first node N1 through the data line, the sensing stage is specifically provided, and the sensing driver 12 senses the light emitting current or the light emitting voltage of the organic light emitting diode through the sensing driving line Se during the sensing stage.

For example, in the embodiments as shown in FIG. 3 and FIG. 4, when the plurality of pixel circuits 100 share a data line Data and share a gate line Gate as well, in order to reduce the absolute value of the compensation voltage Vse, thereby reducing the load of the sensing driver 12, the data voltage Vdata that minimizes the sum of the absolute values of the respective compensation voltages Vse of the pixel circuits 100 can be applied to the pixel circuits 100 sharing the data lines Data and the gate lines Gate simultaneously.

For another example, the method of applying data signals is not limited to the case that enables the sum of the absolute values of the respective compensation voltages Vse of the pixel circuits 100 sharing the data lines Data and the gate lines Gate simultaneously to be minimum, and can also apply the data voltages Vdata that enable the maximum of the absolute values of the respective compensation voltages Vse of the pixel circuits 100 sharing the data lines Data and the gate lines Gate simultaneously to be minimum.

An embodiment of the present disclosure further provides a display panel, and the display panel comprises a plurality of sub-pixels arranged in rows and columns, a plurality of data lines connected to the plurality of sub-pixels, and a plurality of sensing driving lines connected to the plurality of sub-pixels, each of the sub-pixels comprises a pixel circuit; the plurality of sub-pixels constitute a plurality of pixel units, the plurality of pixel units are arranged in a plurality of rows and a plurality of columns, and each of the plurality of pixel units comprises four sub-pixels; pixel circuits of the four sub-pixels are connected to a same data line of the plurality of data lines; and the pixel circuits of the four sub-pixels are connected to four sensing driving lines of the plurality of sensing driving lines in a one-to-one correspondence manner.

Figure 9:
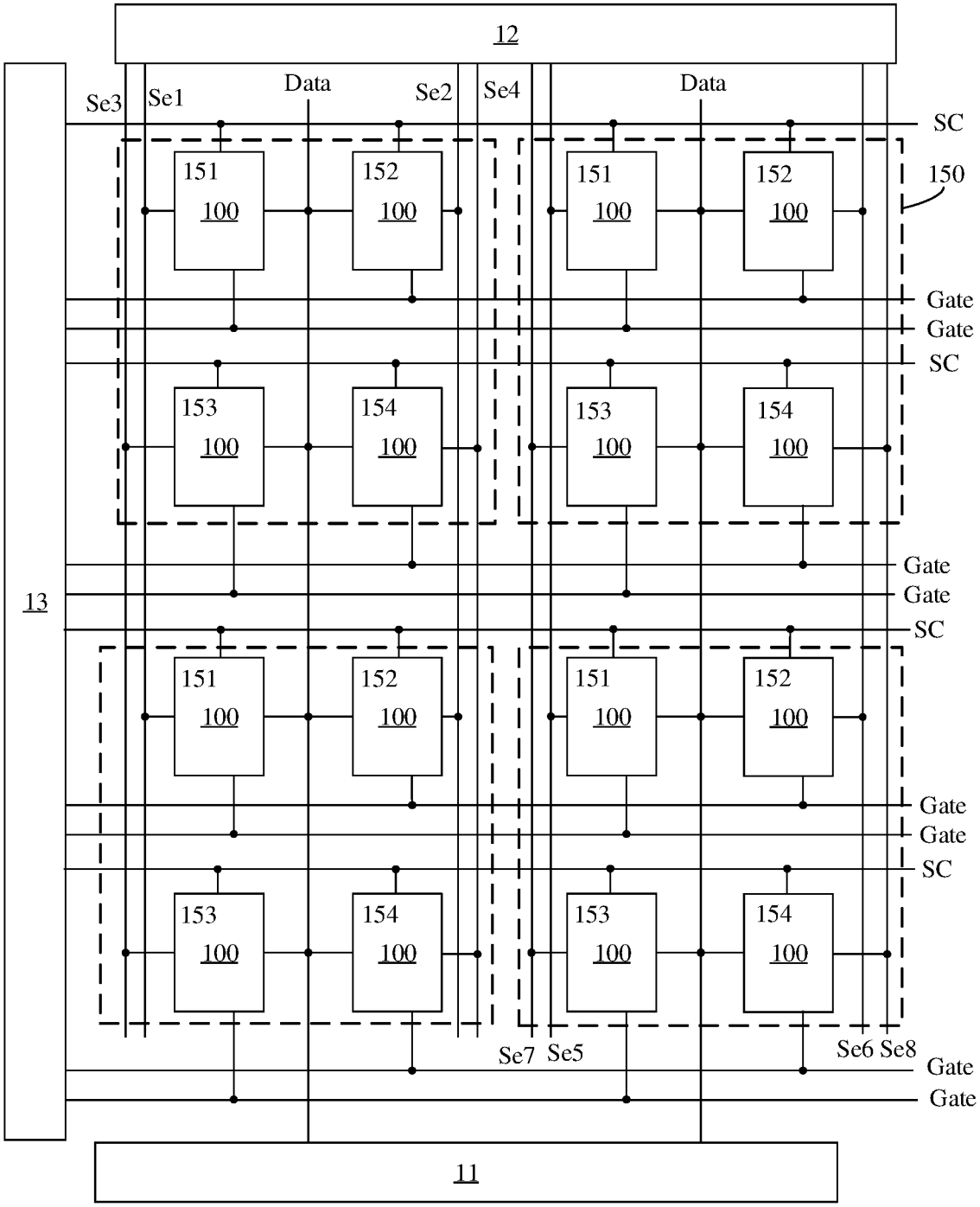
FIG. 9 is a schematic diagram of a display panel provided by at least one embodiment of the present disclosure.

FIG. 9 is a schematic diagram of a display panel provided by at least one embodiment of the present disclosure.

For example, as shown in FIG. 9, a display panel 10 provided by an embodiment of the present disclosure includes a plurality of sub-pixels arranged in an array, and the sub-pixels are arranged in rows and columns. Each sub-pixel includes a pixel circuit 100, and the pixel circuit 100 includes a light emitting element such as an organic light emitting diode. The display panel 10 further includes a data driver 11, a sensing driver 12, a scan driver 13, a plurality of data lines Data, a plurality of gate lines Gate, and a plurality of sensing driving lines Se. The plurality of sensing driving lines Se are connected to the sensing driver 12. In FIG. 9, the plurality of data lines Data extend parallel to each other and extend longitudinally, the plurality of gate lines Gate extend parallel to each other and extend laterally, and the plurality of sensing driving lines Se extend parallel to each other and extend longitudinally.

For example, as shown in FIG. 9, the plurality of sub-pixels constitute a plurality of pixel units 150, the plurality of pixel units 150 are arranged in a plurality of rows and a plurality of columns, and each of the plurality of pixel units 150 comprises four sub-pixels 151-154; pixel circuits of the four sub-pixels are connected to a same data line of the plurality of data lines Data; and the pixel circuits of the four sub-pixels are connected to four sensing driving lines of the plurality of sensing driving lines in a one-to-one correspondence manner.

In the display panel provided by the embodiments of the present disclosure, the pixel circuits of the same pixel unit share the same data line and the pixel circuits in the same pixel unit are respectively connected to different sensing driving lines, thereby increasing the aperture ratio, reducing the parasitic capacitance of the sensing driving lines, increasing the sensing speed, improving the sensing accuracy of the threshold voltage and the compensation accuracy of the threshold voltage, and achieving that under the high aperture ratio pixel design, the condition of the light emitting element can still be quickly and easily sensed and then compensated.

For example, as shown in FIG. 9, in some embodiments, in each pixel unit 150, the four sub-pixels are arranged in two rows and two columns. The present disclosure is not limited thereto, in other embodiments, in each pixel unit 150, the four sub-pixels may also be arranged in a row and four columns or four rows and a column. Hererinafter, the embodiments of the present disclosure are described by taking a case that the four sub-pixels are arranged in two rows and two columns as an example.

For example, in each pixel unit 150, the four sub-pixels include a first sub-pixel 151 located in a first row and a first column, a second sub-pixel 152 located in a first row and a second column, a third sub-pixel 153 located in a second row and a first column, and a fourth sub-pixel 154 located in a second row and a second column.

For example, the four sensing driving lines include a first sensing driving line Se1, a second sensing driving line Se2, a third sensing driving line Se3, and a fourth sensing driving line Se4. For example, the first sub-pixel 151 is connected to the first sensing driving line Se1, the second sub-pixel 152 is connected to the second sensing driving line Se2, the third sub-pixel 153 is connected to the third sensing driving line Se3, and the fourth sub-pixel 154 is connected to the fourth sensing driving line Se4.

For example, in some embodiments, the pixel circuits of the sub-pixels of the pixel units 150 located in the same column are connected to four sensing driving lines. For example, as shown in FIG. 9, for the pixel units 150 located in the same column, all first sub-pixels 151 are connected to the first sensing driving line Se1, all second sub-pixels 152 are connected to the second sensing driving line Se2, all third sub-pixels 153 are connected to the third sensing driving line Se3, and all fourth sub-pixels 154 are connected to the fourth sensing driving line Se4.

It should be noted that, as shown in FIG. 9, the plurality of sensing driving lines further include a fifth sensing driving line Se5, a sixth sensing driving line Se6, a seventh sensing driving line Se7, and an eighth sensing driving line Se8. The sub-pixels of the pixel units 150 in the first column are connected to the first sensing driving line Se1, the second sensing driving line Se2, the third sensing driving line Se3, and the fourth sensing driving line Se4, and the sub-pixels of the pixel units 150 in the second column are connected to the fifth sensing driving line Se5, the sixth sensing driving line Se6, the seventh sensing driving line Se7, and the eighth sensing driving line Se8. For example, all first sub-pixels 151 of the pixel units 150 in the second column are connected to the fifth sensing drive line Se5, all second sub-pixels 152 of the pixel units 150 in the second column are connected to the sixth sensing drive line Se6, all third sub-pixels 153 of the pixel units 150 in the second column are connected to the seventh sensing driving line Se7, and all fourth sub-pixels 154 of the pixel units 150 in the second column are connected to the eighth sensing driving line Se8.

For example, the pixel circuits of the sub-pixels of the pixel units 151 located in the same column are connected to the same data line.

For example, in some embodiments, the first sub-pixel 151 is a red sub-pixel, the second sub-pixel 152 is a green sub-pixel, the third sub-pixel 153 is a blue sub-pixel, and the fourth sub-pixel 154 is a white sub-pixel.

For example, the data driver 11 is configured to provide data signals to the pixel circuits 100. The sensing driver 12 is configured to sense electrical parameters of light emitting elements (for example, organic light emitting diodes) through the sensing driving lines Se, and the electrical parameters, for example, are light emitting currents or light emitting voltages of the light emitting elements. The sensing driver 12 is also configured to generate compensation signals according to the sensed electrical parameters, and transmit the compensation signals to the pixel circuits 100 of the sub-pixels through the sensing driving lines Se. For example, the compensation signals are compensation currents or compensation voltages. The scan driver 13 is configured to provide gate driving signals to the pixel circuits 100.

For example, the sensing driver 12 can sense the electrical parameters (light emitting currents or light emitting voltages) of the light emitting elements in the sub-pixels through the sensing driving lines Se, and the sensing driver 12 may further generate compensation signals (such as compensation currents or compensation voltages) according to the sensed electrical parameters, and transmit the compensation signals to the pixel circuits 100 through the sensing driving lines Se, thereby controlling the light emitting intensity of the light emitting elements.

For example, the display panel 10 further includes a controller (not shown in figures), the controller is coupled with the data driver 11, the sensing driver 12 and the scan driver 13, and is configured to provide control instructions and/or timing signals to the data driver 11, the sensing driver 12 and the scan driver 13, whereby the data driver 11, the sensing driver 12 and scan driver 13 cooperate with each other.

It should be noted that, for the specific structures and functions of the controller, the data driver 11, the sensing driver 12, and the scan driver 13, reference may be made to the related descriptions of the above embodiments, and the similar portions are not repeated here.

For example, the data driver 11 and the sensing driver 12 can be connected together to facilitate data interaction between the sensing driver 12 and the data driver 11.

For example, as shown in FIG. 9, two pixel circuits 100 connected to the same data line Data in the same row are respectively connected with two different gate lines Gate. For another example, in the same row, the pixel circuits 100 of the sub-pixels in the (2n−1)th column are connected with a gate line Gate, and the pixel circuits 100 of the sub-pixels in the adjacent (2n)th column are connected with another gate line Gate, and the two gate lines can be arranged adjacent to each other, for example, arranged between two adjacent rows of sub-pixels. This arrangement enables the pixel circuits 100 of the sub-pixels in the (2n−1)th column and the pixel circuits 100 of the sub-pixels in the adjacent (2n)th column to be turned on in a time-sharing manner. Therefore, it is convenient to use the common data line Data to provide different data signals for the pixel circuits 100 sharing the data line Data.

For example, as shown in FIG. 9, the display panel 10 further includes sensing driving control lines SC, and the sensing driving control lines SC are connected with the scan driver 13.

Figure 10:
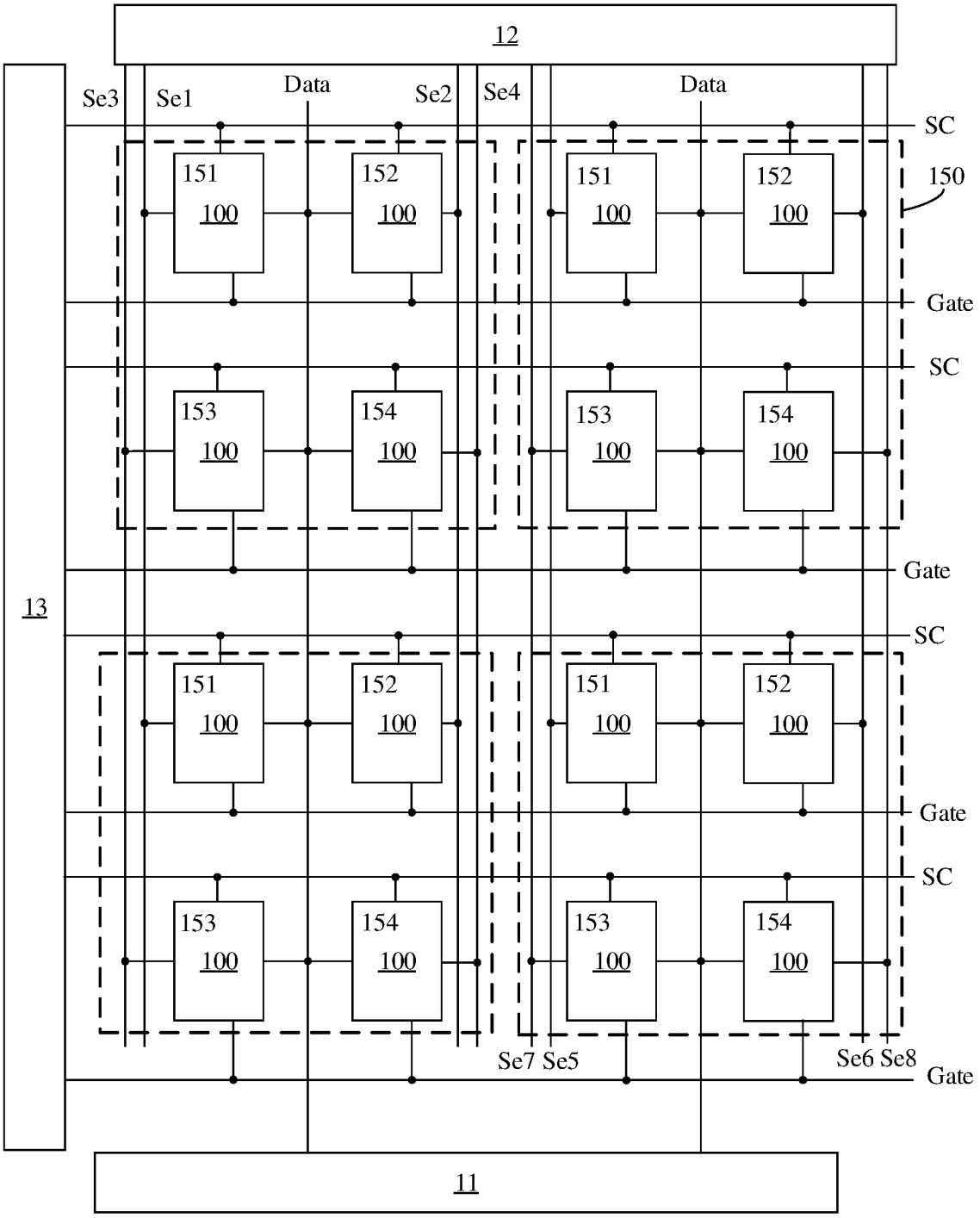
FIG. 10 is a schematic diagram of another display panel provided by at least one embodiment of the present disclosure.
Figure 11:
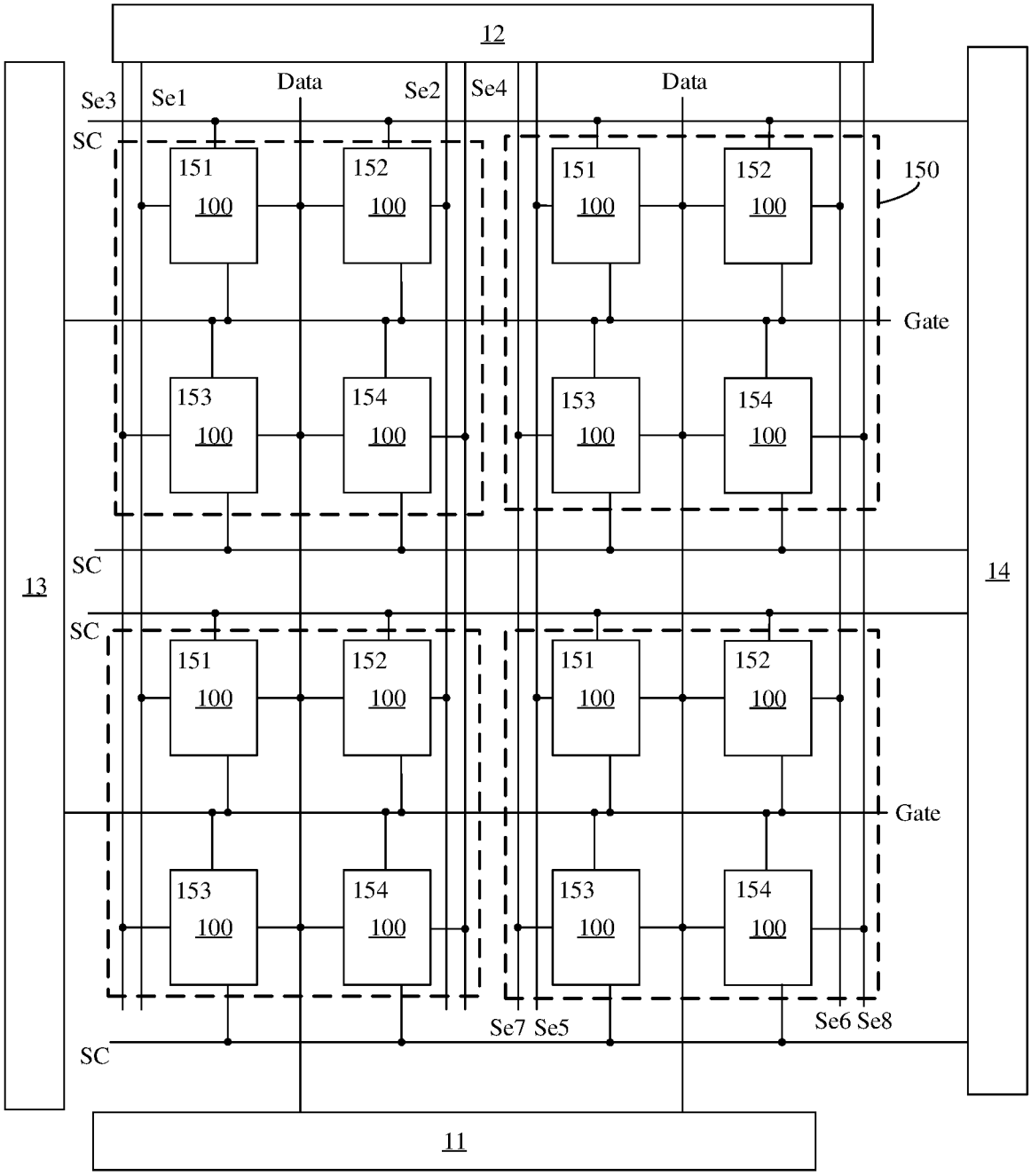
FIG. 11 is a schematic diagram of still another display panel provided by at least one embodiment of the present disclosure.

FIG. 10 is a schematic diagram of another display panel provided by at least one embodiment of the present disclosure; FIG. 11 is a schematic diagram of still another display panel provided by at least one embodiment of the present disclosure.

For example, as shown in FIG. 10, in a display panel provided by an embodiment of the present disclosure, the pixel circuits 100 of each row of sub-pixels can be connected with a same gate line Gate. This arrangement enables the pixel circuits 100 of the same row to be turned on at the same time, and the common data line Data provides the same data signal to the pixel circuits 100, which shares the data line Data, in the same row. In this case, the light emitting luminance of the organic light emitting diodes in the pixel circuits 100 sharing the data line Data can be controlled by the compensation voltages transmitted from the sensing driving lines Se to the pixel circuits 100, and a specific compensation process can refer to the relevant description above. Compared with the arrangement as shown in FIG. 9, the arrangement as shown in FIG. 10 reduces the number of gate lines Gate (the number of gate lines Gate is reduced, for example, to a half of the arrangement as shown in FIG. 9), thereby further increasing the aperture ratio of the display panel, reducing parasitic capacitance, and facilitating wiring and production of the display panel.

For example, as shown in FIG. 11, in a display panel provided by at least one embodiment of the present disclosure, pixel circuits of the sub-pixels in the (2m−1)th row and pixel circuits of the sub-pixels in the (2m)th row are connected with a same gate line, and m is an integer greater than zero. This arrangement enables the pixel circuits 100 of the sub-pixels in the (2m−1)th row and the pixel circuits 100 of the sub-pixels in the (2m)th row to be turned on at the same time, and the common data line Data provides the same data signal to pixel circuits 100, which shares the data line Data, in two rows and two adjacent columns. The light emitting luminance of the organic light emitting diodes in the pixel circuits 100 sharing the data line Data can be controlled by the compensation voltages transmitted from the sensing driving lines Se to the pixel circuits 100, and a specific compensation process can refer to the relevant description above. Compared with the arrangements of the embodiments shown in FIG. 9 and FIG. 10, the arrangement of the embodiment shown in FIG. 11 reduces the number of gate lines Gate (the number of gate lines Gate is reduced, for example, to a quarter of the arrangement as shown in FIG. 9), thereby further increasing the aperture ratio of the display panel, reducing the parasitic capacitance, and facilitating wiring and production of the display panel. In other words, the display panel can also adopt a double-row scanning manner, that is, two rows of pixel circuits are simultaneously in a charged state at any time, and each pixel circuit can be provided twice as much charging time as the original progressive scan driving manner, which ensures display quality of picture, especially for large-size, high-resolution OLED display products.

For example, the sensing driving control lines SC and the gate lines Gate are not limited to the case of sharing the scan driver 13. As shown in FIG. 11, in at least one embodiment, the display panel 10 further includes a sensing driving control circuit 14 independent of the scan driver 13, the sensing driving control lines SC are connected with the sensing driving control circuit 14, and the sensing driving control circuit 14 can provide the sensing driving control signals for the sensing driving control lines SC. As shown in FIG. 11, the scan driver 13 and the sensing driving control circuit 14 are located on two sides of the sub-pixel array, respectively, and the scan driver 13 and the sensing driving control circuit 14 can also be located on a same side.

For example, as shown in FIG. 9 to FIG. 11, the pixel circuits 100 of the four sub-pixels of each pixel unit are respectively connected to different four sensing driving lines Se, so as to implement to transmit different compensation voltages to the pixel circuits 100 of the four sub-pixels of each pixel unit.

For example, as shown in FIG. 9 to FIG. 11, in a display panel provided by at least one embodiment of the present disclosure, the data lines Data extend in a same direction as the sensing driving lines Se. This arrangement can facilitate the setting of the data driver 11 and the sensing driver 12 while avoiding overlap of the data lines Data and the sensing driving lines Se, thereby reducing the parasitic capacitance.

For example, in a display panel provided by at least one embodiment of the present disclosure, only one of the data lines Data or one of the sensing driving lines Se is disposed between the pixel circuits 100 of every two adjacent columns sub-pixels. This arrangement can reduce the mutual influence between the data lines Data and the sensing driving lines Se, further reduce the parasitic capacitance and improve the display quality. As shown in FIG. 9 to FIG. 11, in pixel units of each column, only the data line Data is provided between the pixel circuits 100 of two adjacent columns of sub-pixels, and only the sensing driving line Se is provided between the pixel units of adjacent two columns.

For example, the data lines Data are formed in the same layer as the sensing driving lines Se.

For example, a display panel 10 provided by at least one embodiment of the present disclosure further includes a first power supply line (not shown in figures) and a second power supply line (not shown in figures), the first power supply line is configured to provide first power supply voltages VDD to the pixel circuits 100, and the second power supply line is configured to provide second power supply voltages VSS to the pixel circuits 100. For example, the second power supply line can be connected with a cathode of the OLED.

For example, the first power supply voltage VDD can be a high level voltage (for example, 5V), and the second power supply voltage VSS can be a low level voltage (for example 0V or connected with the ground).

For example, as shown in FIG. 5, the pixel circuit further includes a light emitting driving circuit 110 and a sensing diving control circuit 120. The light emitting driving circuit 110 is configured to drive the OLED to emit light during operation. The sensing diving control circuit 120 is configured to control connection and disconnection of the sensing driving lines Se with the light emitting driving circuit 110 in the pixel circuit 100.

For example, as shown in FIG. 5 and FIG. 6A, in a display panel provided by at least one embodiment of the present disclosure, the light emitting driving circuit 110 includes a first transistor T1 (a driving transistor), a second transistor T2, and a storage capacitor Cst. A first electrode of the first transistor T1 is connected with the first power supply line to receive the first power supply voltage VDD, a gate electrode of the first transistor T1 is connected with a first node N1, and a second electrode of the first transistor T1 is connected with a second node N2. A first electrode of the second transistor T2 is connected with the data line Data to receive the data signal, a gate electrode of the second transistor T2 is connected with the gate line to receive the gate driving signal, and a second electrode of the second transistor T2 is connected with the first node N1. A first end of the storage capacitor Cst is connected with the first node N1, and a second end of the storage capacitor Cst is connected with the second node N2.

For example, the anode of the OLED is connected with the second node N2, and the cathode of the OLED is electrically connected with the second power supply voltage VSS, for example, is electrically connected with the second power supply voltage VSS through the second power supply line.

For example, as shown in FIG. 5 and FIG. 6A, in a display panel provided by at least one embodiment of the present disclosure, the sensing diving control circuit 120 includes a third transistor, a first electrode of the third transistor T3 is connected with the second node N2, a gate electrode of the third transistor T3 is connected with the sensing driving control line SC to receive the sensing driving control signal, and a second electrode of the third transistor T3 is connected with the corresponding sensing driving line Se.

Figure 12:
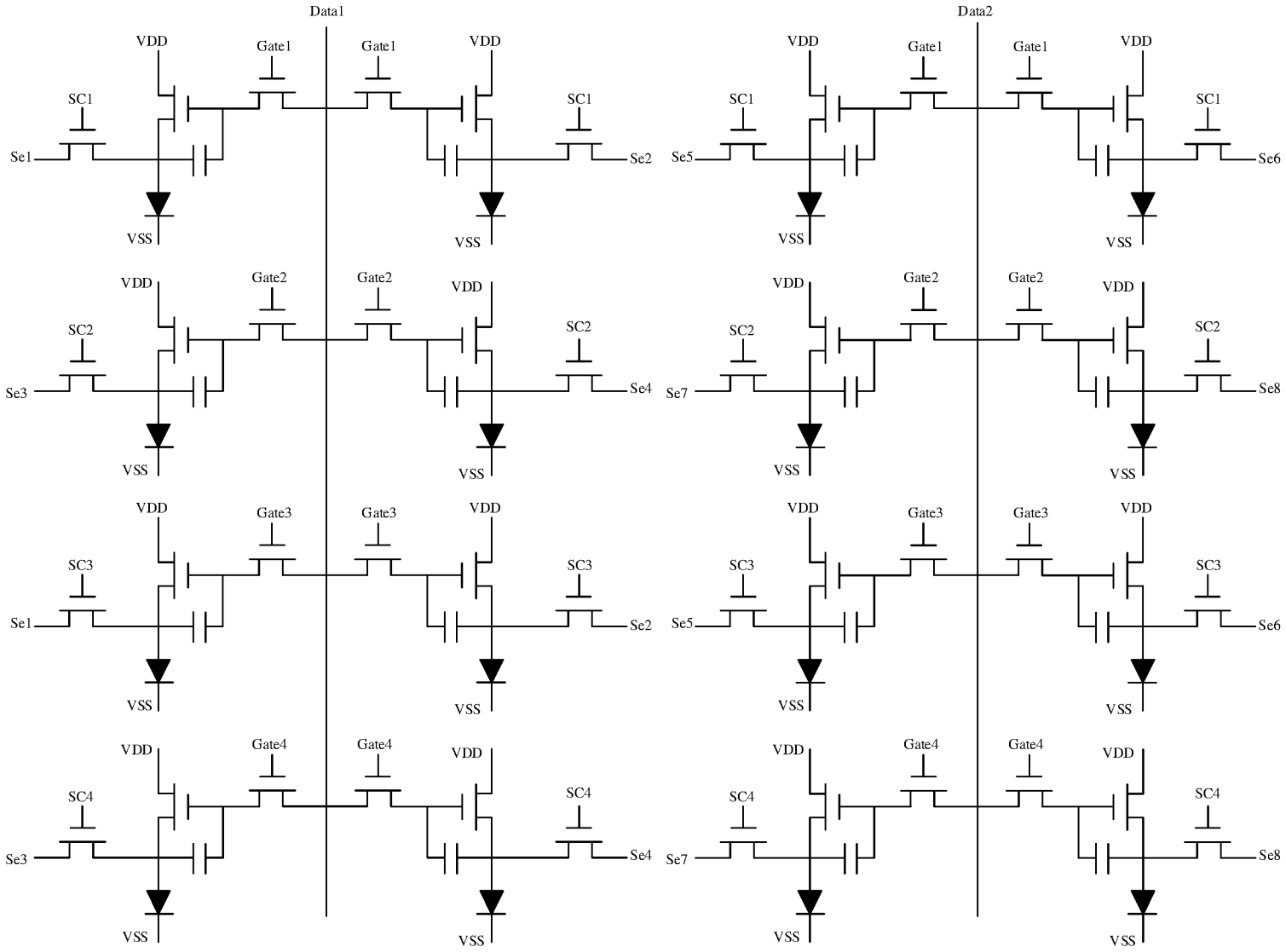
FIG. 12 is a fourth schematic diagram of a pixel circuit in a display panel provided by the embodiment of the present disclosure.

FIG. 12 is a fourth schematic diagram of a pixel circuit in a display panel provided by the embodiment of the present disclosure.

FIG. 12 shows 16 sub-pixels, and each sub-pixel adopts the pixel circuit as shown in FIG. 6A. For example, the pixel units located in the first column share the same data line Data1, the pixel units located in the second column share the same data line Data2, the sub-pixels located in the first row are connected to the same gate line Gate1 and the same sensing driving control line SC1, the sub-pixels located in the second row are connected to the same gate line Gate2 and the same sensing driving control line SC2, the sub-pixels located in the third row are connected to the same gate line Gate3 and the same sensing driving control line SC3, and the sub-pixels located in the fourth row are connected to the same gate line Gate4 and the same sensing driving control line SC4.

Referring to FIG. 6, when the first transistor T1 is sensed, a loop that passes through the first power supply voltage VDD, the first transistor T1, the third transistor T3, and the sensing driving line Se in sequence can be formed; when the organic light emitting diode OLED is sensed, a loop that passes through the second power supply voltage VSS, the organic light emitting diode OLED, the third transistor T3, and the sensing driving line Se in sequence can be formed. The four sub-pixels in the same pixel unit are respectively sensed by four sensing driving lines Se, so that the sensing of the four sub-pixels can be achieved at the same time, thereby improving the sensing speed.

For example, for the pixel units located in the first column, all first sub-pixels are connected to the first sensing driving line Se1, all second sub-pixels are connected to the second sensing driving line Se2, all third sub-pixels are connected to the third sensing driving line Se3, and all fourth sub-pixels are connected to the fourth sensing driving line Se4; for the pixel units located in the second column, all first sub-pixels are connected to the fifth sensing driving line Se5, all second sub-pixels are connected to the sixth sensing driving line Se6, all third sub-pixels are connected to the seventh sensing driving line Se7, and all fourth sub-pixels are connected to the eighth sensing driving line Se8.

It should be noted that, for the specific compensation process, reference may be made to the relevant descriptions of FIGS. 7 and 8 above, and similar portions will not be repeated.

Figure 13:
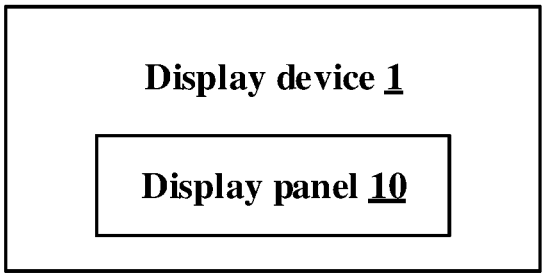
FIG. 13 is a schematic diagram of a display device provided by an embodiment of the present disclosure.

An embodiment of the present disclosure further provides a display device 1, as shown in FIG. 13, the display device 1 includes the display panel 10 provided by any embodiment of the present disclosure. In at least one embodiment of the present disclosure, the display device 1 further includes a signal receiving circuit, a video signal decoding circuit, etc. so as to receive and process the video signal, or further includes a modem circuit or an antenna, etc. so as to be coupled with other devices through the network, wireless signals, etc.

For example, the display device 1 provided by an embodiment of the present disclosure can be any product or component with display function such as a mobile phone, a tablet PC, a TV, a display, a notebook computer, a digital picture frame and a navigator.

Figure 14:
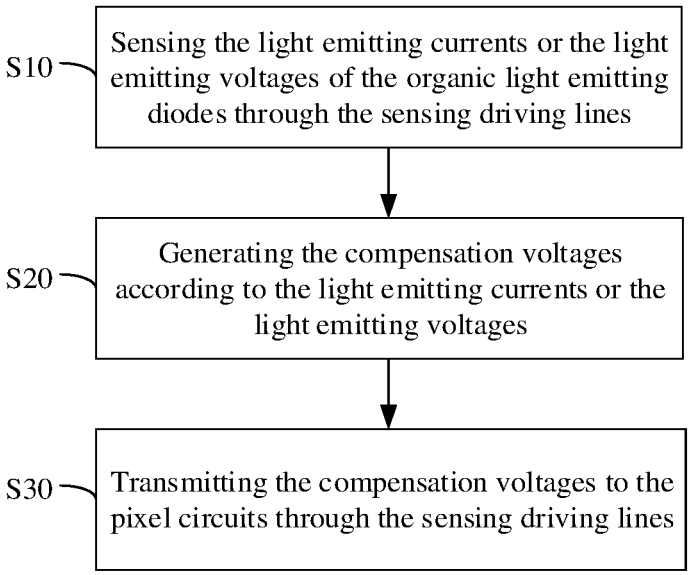
FIG. 14 is a first flowchart of a compensation method provided by an embodiment of the present disclosure.

An embodiment of the present disclosure further provides a compensating method for a display panel 10 provided by any embodiment of the present disclosure. As shown in FIG. 14, the method includes the following steps.

Step S10: sensing the light emitting currents or the light emitting voltages of the organic light emitting diodes through the sensing driving lines;

Step S20: generating the compensation voltages according to the light emitting currents or the light emitting voltages; and Step S30: transmitting the compensation voltages to the pixel circuits through the sensing driving lines.

Herein, the light emitting current or the light emitting voltage is an example of the electrical parameter, and the compensation voltage is an example of the compensation signal, but the embodiments of the present disclosure is not limited to these examples.

For example, in step S20, the sensed light emitting current or the sensed light emitting voltage can be compared with the predetermined light emitting current or the predetermined light emitting voltage, thereby calculating the compensation voltage according to the saturation current equation of the OLED.

For example, when the sensed light emitting current or light emitting voltage is less than the predetermined light emitting current or light emitting voltage, the compensation voltage is decreased.

For example, when the sensed light emitting current or light emitting voltage is greater than the predetermined light emitting current or light emitting voltage, the compensation voltage is increased.

Figure 15:
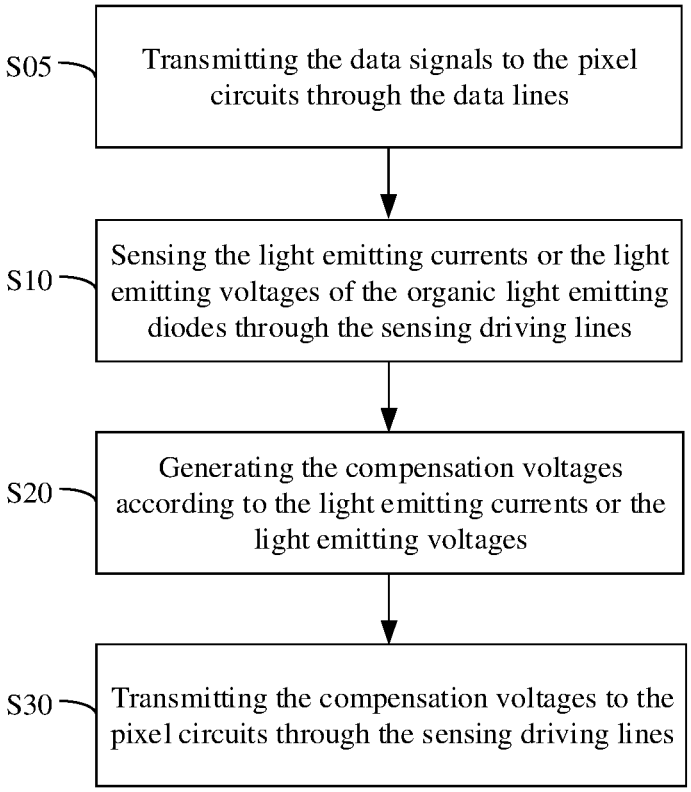
FIG. 15 is a second flowchart of a compensation method provided by an embodiment of the present disclosure.

For example, as shown in FIG. 15, in a method provided in at least one embodiment of the present disclosure, before sensing the light emitting currents or the light emitting voltages of the organic light emitting diodes, the method further includes:

Step S05: transmitting the data signals to the pixel circuits through the data lines.

For example, in the embodiments as shown in FIG. 3, FIG. 4, FIG. 10, and FIG. 11, when the plurality of pixel circuits 100 share a data line Data and share a gate line Gate as well, in order to reduce the absolute value of the compensation voltage Vse, thereby reducing the load of the sensing driver 12, the data voltage Vdata that minimizes the sum of the absolute values of the respective compensation voltages Vse of the pixel circuits 100 can be applied to the pixel circuits 100 sharing the data lines Data and the gate lines Gate simultaneously.

For another example, the method of applying data signals is not limited to the case that enables the sum of the absolute values of the respective compensation voltages Vse of the pixel circuits 100 sharing the data lines Data and the gate lines Gate simultaneously to be minimum, and can also apply the data voltages Vdata that enable the maximum of the absolute values of the respective compensation voltages Vse of the pixel circuits 100 sharing the data lines Data and the gate lines Gate simultaneously to be minimum.

A display panel, a display device and a compensating method provided by the embodiments of the present disclosure can increase the aperture ratio and reduce the parasitic capacitance by sharing data lines between adjacent pixel circuits, and perform the operation of sensing of the light emitting current or the light emitting voltage of the organic light emitting diode by sharing sensing driving lines and compensating for the drift of the threshold voltages of the driving transistors.

What have been described above are only exemplary embodiments of the present disclosure but not to limit the protection scope of the present disclosure, and the protection scope of the present disclosure is determined by the appended claims.

What is claimed is:

1. A display panel, comprising:

a plurality of sub-pixels arranged in rows and columns, a plurality of data lines connected to the plurality of sub-pixels, and a plurality of sensing driving lines connected to the plurality of sub-pixels, wherein each of the sub-pixels comprises a pixel circuit;

the plurality of sub-pixels constitute a plurality of pixel units, the plurality of pixel units are arranged in a plurality of rows and a plurality of columns, and each of the plurality of pixel units comprises four sub-pixels;

pixel circuits of the four sub-pixels are connected to a same data line of the plurality of data lines;

the pixel circuits of the four sub-pixels are connected to four sensing driving lines of the plurality of sensing driving lines in a one-to-one correspondence manner;

in each of the plurality of pixel units, the four sub-pixels are arranged in two rows and two columns;

the four sensing driving lines comprises a first sensing driving line, a second sensing driving line, a third sensing driving line, and a fourth sensing driving line, in each of the plurality of pixel units, the four sub-pixels comprise a first sub-pixel located in a first row and a first column, a second sub-pixel located in the first row and a second column, a third sub-pixel located in a second row and the first column, and a fourth sub-pixel located in the second row and the second column, in pixel units located in a same column, all first sub-pixels are connected to the first sensing driving line, all second sub-pixels are connected to the second sensing driving line, and all third sub-pixels are connected to the third sensing driving line, and all fourth sub-pixels are connected to the fourth sensing driving line;

the first sensing driving line and the third sensing driving line are located on a same side of pixel units to which the first sensing driving line, the second sensing driving line, the third sensing driving line, and the fourth sensing driving line are connected, the second sensing driving line and the fourth sensing driving line are located on a same side of the pixel units to which the first sensing driving line, the second sensing driving line, the third sensing driving line, and the fourth sensing driving line are connected, and the first sensing driving line and the second sensing driving line are located on two opposite sides of the pixel units to which the first sensing driving line, the second sensing driving line, the third sensing driving line, and the fourth sensing driving line are connected.

2. The display panel according to claim 1, wherein the first sub-pixel is a red sub-pixel, the second sub-pixel is a green sub-pixel, the third sub-pixel is a blue sub-pixel, and the fourth sub-pixel is a white sub-pixel.

3. The display panel according to claim 1, wherein pixel circuits of sub-pixels of pixel units located in a same column are connected to a same data line.

4. The display panel according to claim 1, further comprising a sensing driver connected with the plurality of sensing driving lines, wherein the pixel circuit comprises a light emitting element, the sensing driver is configured to sense electrical parameters of light emitting elements of pixel circuits of the plurality of sub-pixels through the plurality of sensing driving lines, and the sensing driver is configured to generate compensation signals according to the electrical parameters, and transmit the compensation signals to the pixel circuits of the plurality of sub-pixels through the plurality of sensing driving lines.

5. The display panel according to claim 4, wherein the light emitting element is an organic light emitting diode, the electrical parameters comprise a light emitting current or a light emitting voltage of the organic light emitting diode, and the compensation signals comprise a compensation voltage or a compensation current.

6. The display panel according to claim 1, further comprising a plurality of gate lines connected with pixel circuits of the plurality of sub-pixels, wherein pixel circuits of sub-pixels in a same row are connected with a same gate line among the plurality of gate lines.

7. The display panel according to claim 1, further comprising a plurality of gate lines connected with the pixel circuits of the plurality of sub-pixels, wherein pixel circuits of the sub-pixels in a (2m−1)th row and pixel circuits of the sub-pixels in a (2m)th row are connected with a same gate line, and m is an integer greater than zero.

8. The display panel according to claim 1, wherein the plurality of data lines extend in a same direction as the plurality of sensing driving lines.

9. The display panel according to claim 1, wherein only one of the plurality of data lines or only one of the plurality of sensing driving lines is arranged between pixel circuits of every adjacent two columns of the plurality of sub-pixels.

10. The display panel according to claim 1, wherein the plurality of data lines are formed in a same layer as the plurality of sensing driving lines.

11. The display panel according to claim 1, wherein pixel circuits of sub-pixels of pixel units located in a same column are connected to a same data line, and the pixel circuits of the sub-pixels of the pixel units located in the same column are connected to four sensing driving lines.

12. The display panel according to claim 1, wherein the pixel circuit further comprises:

a light emitting element;

a light emitting driving circuit, configured to drive the light emitting element to emit light during operation, and a sensing diving control circuit, configured to control connection and disconnection of the sensing driving line with the light emitting driving circuit in the pixel circuit.

13. The display panel according to claim 12, wherein the light emitting driving circuit comprises a first transistor, a second transistor and a storage capacitor, a first electrode of the first transistor is connected with a first power supply line to receive a first power supply voltage, a gate electrode of the first transistor is connected with a first node, and a second electrode of the first transistor is connected with a second node;

a first electrode of the second transistor is connected with a data line, corresponding to the pixel circuit, in the plurality of data lines to receive a data signal, a gate electrode of the second transistor is connected with a gate line to receive a gate driving signal, and a second electrode of the second transistor is connected with the first node; and a first end of the storage capacitor is connected with the first node, and a second end of the storage capacitor is connected with the second node.

14. The display panel according to claim 12, wherein the sensing diving control circuit comprises a third transistor, a first electrode of the third transistor is connected with the second node, a gate electrode of the third transistor is connected with a sensing driving control line to receive a sensing driving control signal, and a second electrode of the third transistor is connected with a sensing driving line, corresponding to the pixel circuit, among the plurality of sensing driving control lines.

15. The display panel according to claim 1, further comprising:

a data driver, configured to provide data signals to pixel circuits of the plurality of sub-pixels; and a scan driver, configured to provide gate driving signals to the pixel circuits of the plurality of sub-pixels.

16. A display device, comprising a display panel, wherein the display panel comprises: a plurality of sub-pixels arranged in rows and columns, a plurality of data lines connected to the plurality of sub-pixels, and a plurality of sensing driving lines connected to the plurality of sub-pixels, each of the sub-pixels comprises a pixel circuit;

the plurality of sub-pixels constitute a plurality of pixel units, the plurality of pixel units are arranged in a plurality of rows and a plurality of columns, and each of the plurality of pixel units comprises four sub-pixels;

pixel circuits of the four sub-pixels are connected to a same data line of the plurality of data lines; and the pixel circuits of the four sub-pixels are connected to four sensing driving lines of the plurality of sensing driving lines in a one-to-one correspondence manner, in each of the plurality of pixel units, the four sub-pixels are arranged in two rows and two columns;

the four sensing driving lines comprises a first sensing driving line, a second sensing driving line, a third sensing driving line, and a fourth sensing driving line, in each of the plurality of pixel units, the four sub-pixels comprise a first sub-pixel located in a first row and a first column, a second sub-pixel located in the first row and a second column, a third sub-pixel located in a second row and the first column, and a fourth sub-pixel located in the second row and the second column, in pixel units located in a same column, all first sub-pixels are connected to the first sensing driving line, all second sub-pixels are connected to the second sensing driving line, and all third sub-pixels are connected to the third sensing driving line, and all fourth sub-pixels are connected to the fourth sensing driving line;

the first sensing driving line and the third sensing driving line are located on a same side of pixel units to which the first sensing driving line, the second sensing driving line, the third sensing driving line, and the fourth sensing driving line are connected, the second sensing driving line and the fourth sensing driving line are located on a same side of the pixel units to which the first sensing driving line, the second sensing driving line, the third sensing driving line, and the fourth sensing driving line are connected, and the first sensing driving line and the second sensing driving line are located on two opposite sides of the pixel units to which the first sensing driving line, the second sensing driving line, the third sensing driving line, and the fourth sensing driving line are connected.

17. A compensating method of a display panel, wherein the display panel comprises: a plurality of sub-pixels arranged in rows and columns, a plurality of data lines connected to the plurality of sub-pixels, and a plurality of sensing driving lines connected to the plurality of sub-pixels, each of the sub-pixels comprises a pixel circuit and a light emitting element;

the plurality of sub-pixels constitute a plurality of pixel units, the plurality of pixel units are arranged in a plurality of rows and a plurality of columns, and each of the plurality of pixel units comprises four sub-pixels;

pixel circuits of the four sub-pixels are connected to a same data line of the plurality of data lines; and the pixel circuits of the four sub-pixels are connected to four sensing driving lines of the plurality of sensing driving lines in a one-to-one correspondence manner, the compensating method comprises:

sensing the electrical parameters of light emitting elements of the plurality of sub-pixels through the plurality of sensing driving lines;

generating the compensation signals according to the electrical parameters; and transmitting the compensation signals to pixel circuits of the plurality of sub-pixels through the plurality of sensing driving lines, in each of the plurality of pixel units, the four sub-pixels are arranged in two rows and two columns;

the four sensing driving lines comprises a first sensing driving line, a second sensing driving line, a third sensing driving line, and a fourth sensing driving line, in each of the plurality of pixel units, the four sub-pixels comprise a first sub-pixel located in a first row and a first column, a second sub-pixel located in the first row and a second column, a third sub-pixel located in a second row and the first column, and a fourth sub-pixel located in the second row and the second column, in pixel units located in a same column, all first sub-pixels are connected to the first sensing driving line, all second sub-pixels are connected to the second sensing driving line, and all third sub-pixels are connected to the third sensing driving line, and all fourth sub-pixels are connected to the fourth sensing driving line;

the first sensing driving line and the third sensing driving line are located on a same side of pixel units to which the first sensing driving line, the second sensing driving line, the third sensing driving line, and the fourth sensing driving line are connected, the second sensing driving line and the fourth sensing driving line are located on a same side of the pixel units to which the first sensing driving line, the second sensing driving line, the third sensing driving line, and the fourth sensing driving line are connected, and the first sensing driving line and the second sensing driving line are located on two opposite sides of the pixel units to which the first sensing driving line, the second sensing driving line, the third sensing driving line, and the fourth sensing driving line are connected.

18. The compensating method according to claim 17, before sensing the electrical parameters of the light emitting elements, further comprising:

transmitting data signals to the pixel circuits through the plurality of data lines.

* * * * *